US008915577B2

(12) United States Patent
Yamada et al.

(10) Patent No.: US 8,915,577 B2
(45) Date of Patent: Dec. 23, 2014

(54) PRINTING APPARATUS

(71) Applicant: Seiko Epson Corporation, Tokyo (JP)

(72) Inventors: Shinichi Yamada, Nagano-ken (JP); Hiroki Hayashi, Nagano-ken (JP); Ryoichi Tanaka, Nagano-ken (JP); Noboru Tamura, Nagano-ken (JP); Akito Sato, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/849,058

(22) Filed: Mar. 22, 2013

(65) Prior Publication Data

US 2014/0015898 A1 Jan. 16, 2014

(30) Foreign Application Priority Data

Jul. 10, 2012 (JP) ..... 2012-154353

(51) Int. Cl.

| | |
|---|---|
| ***B41J 2/15*** | (2006.01) |
| ***B41J 2/145*** | (2006.01) |
| ***B41J 2/21*** | (2006.01) |
| ***B41J 3/54*** | (2006.01) |

(52) U.S. Cl.

CPC ..... *B41J 2/145* (2013.01); *B41J 2/2132* (2013.01); *B41J 3/543* (2013.01)

USPC ..... 347/49; 347/43

(58) Field of Classification Search

USPC ..... 347/43, 49

See application file for complete search history.

(56) References Cited

U.S. PATENT DOCUMENTS 6,616,267 B2 * 9/2003 Weijkamp ..... 347/43

FOREIGN PATENT DOCUMENTS

| | | |
|---|---|---|
| JP | 2003-200604 | 7/2003 |
| JP | 2003-341054 | 12/2003 |

* cited by examiner

*Primary Examiner* — Stephen Meier
*Assistant Examiner* — Alexander D Shenderov

(57) ABSTRACT

A printing apparatus includes a first head that forms a first dot group and a second head that forms a second dot group. The first head has a first nozzle row for a first chromatic ink and a second nozzle row for a second chromatic ink. The second head has a third nozzle row for the first chromatic ink and a fourth nozzle row for the second chromatic ink. With respect to at least the first chromatic ink or the second chromatic ink, in a case in which the number of dots that configure dot rows that are lined up in the main scanning direction, is 3500 or more, a rational number, which is expressed using a number of dots included in the first dot group and a number of dots included in the second dot group in the dot rows, is a value other than zero.

4 Claims, 13 Drawing Sheets

PRINTING APPARATUS

BACKGROUND

1. Technical Field

The present invention relates to a printing apparatus.

2. Related Art

Ink jet printers that form images configured by groups of ink dots on a print medium by moving a print head that has a plurality of nozzles along a main scanning direction while discharging ink from each nozzle by driving an actuator provided to correspond to each nozzle of the print head are in widespread use.

In ink jet printers, the components for an ink discharge operation such as the nozzle actuator are driven in a period in which the ink discharge operation (image formation operation) from nozzles is executed, and the components and a drive circuit generate heat. Therefore, in a case in which printing is performed at a relatively high resolution on a relatively large print medium (for example, a case in which printing is performed at a resolution of 300 dpi or more on an A3 or larger print medium), there are cases in which excessive loads are applied to the components for the ink discharge operation and the component life is shortened and those in which the amount of heat per unit time is excessive and deteriorations in image quality, which accompany damage to the components and the destabilization of discharge, occur. Conventionally, a technology which detects the temperature of the print head, and stops a print operation in a case in which it seems likely that the temperature of the print head will exceed an upper temperature limit at which correct operation is guaranteed, is known (for example, refer to JP A-2003-341054).

In the abovementioned technology of the related art, although it is possible to prevent the occurrence of a state in which the temperature of the print head exceeds an upper temperature limit, depending on the print resolution and the size of the print medium, there are case in which the print operation is stopped before the formation of images on the print medium is completed, and there is a problem in which the convenience for a user is decreased.

Additionally, this kind of problem is not limited to printing using an ink jet method, but is a problem that is common to printing which forms images on a print medium while moving a print head along a predetermined main scanning direction.

SUMMARY

The invention can be realized in the following forms or application examples.

Application Example 1

According to Application Example 1, there is provided a printing apparatus that is provided with a first head that has a first nozzle row that is configured from a plurality of nozzles that discharge a first chromatic ink and a second nozzle row that is configured from a plurality of nozzles that discharge a second chromatic ink, and forms a first dot group on a print medium by moving along a guide member in a main scanning direction and discharging ink using at least the first nozzle row or the second nozzle row, a second head that is different from the first head, has a third nozzle row that is configured from a plurality of nozzles that discharge the first chromatic ink and a fourth nozzle row that is configured from a plurality of nozzles that discharge the second chromatic ink, and forms a second dot group on the print medium by moving along the guide member in the main scanning direction and discharging ink using at least the third nozzle row or the fourth nozzle row, and a transport mechanism that performs a sub-scan that moves the print medium relatively with respect to the guide member in a sub-scanning direction that intersects the main scanning direction, in which a first straight line, which links a central point of a first line segment that links the nozzles of both ends of the first nozzle row and a central point of a second line segment that links the nozzles of both ends of the second nozzle row, crosses a third line segment that links the nozzles of both ends of the third nozzle row and a fourth line segment that links the nozzles of both ends of the fourth nozzle row, and with respect to at least the first chromatic ink or the second chromatic ink, in a case in which the number of dots that configure dot rows that are lined up in the main scanning direction, which are formed as a result of ink discharge executed between a sub-scan and a subsequent sub-scan, is 3500 or more, a rational number, which is expressed using a number of dots included in the first dot group and a number of dots included in the second dot group in the dot rows, is a value other than zero. In this printing apparatus, in addition to being able to realize image formation on the entire print medium while avoiding situations in which the amount of heat per unit time is excessive and deteriorations in image quality, which accompany damage to the components and the destabilization of discharge, occur irrespective of the contents of target images for printing and the size of the print medium, it is possible to prolong component life since the application of excessive loads to the components for the ink discharge operation is avoided.

Application Example 2

In the printing apparatus according to Application Example 1, a second straight line, which links a central point of the third line segment and a central point of the fourth line segment, crosses the first line segment and the second line segment. In this printing apparatus, since it is possible to execute the print process using 75% or more of the nozzles that configure each nozzle row provided in each print head in a case in which the number of dots that configure dot rows that are lined up in the main scanning direction, which are formed as a result of ink discharge executed between a sub-scan and a subsequent sub-scan, is 3500 or more, it is possible to effectively suppress increases in the time required for the print process.

Application Example 3

In the printing apparatus according to Application Example 1 or 2, the distance between an intersection of the first straight line and the third line segment and the central point of the third line segment is shorter than the distance between the intersection and an end point on the near side of the third line segment. In this printing apparatus, since it is possible to execute the print process using 50% or more of the nozzles that configure each nozzle row provided in each print head in a case in which the number of dots that configure dot rows that are lined up in the main scanning direction, which are formed as a result of ink discharge executed between a sub-scan and a subsequent sub-scan, is 3500 or more, it is possible to suppress increases in the time required for the print process.

Application Example 4

In the printing apparatus according to any one of Application Examples 1 to 3, in a case in which the number of dots that configure dot rows that are lined up in the main scanning direction, which are formed as a result of ink discharge executed between a sub-scan and a subsequent sub-scan, is below 3500, among the dots that configure the dot rows, either a number of dots included in the first dot group or a number of dots included in the second dot group is zero. In this printing apparatus, the print process is simplified and it is possible to realize improvements in the speed of the process and the image quality thereof in cases in which the number of dots that configure dot rows that are lined up in the main scanning direction, which are formed as a result of ink discharge executed between a sub-scan and a subsequent sub-scan, is below 3500.

Application Example 5

In the printing apparatus according to any one of Application Examples 1 to 4, in a case in which the number of dots that configure dot rows that are lined up in the main scanning direction, which are formed as a result of ink discharge executed between a sub-scan and a subsequent sub-scan, is 3500 or more, the ink discharge of the first head and the ink discharge of the second head are executed alternately. In this printing apparatus, it is possible to adopt a simple configuration in which two print heads are mounted in one carriage.

Application Example 6

In the printing apparatus of any one of Application Examples 1 to 4, in a case in which the number of dots that configure dot rows that are lined up in the main scanning direction, which are formed as a result of ink discharge executed between a single sub-scan and a subsequent single sub-scan, is 3500 or more, the ink discharge of the first head and the ink discharge of the second head are executed simultaneously. In this printing apparatus, it is possible to achieve an increase in the speed of the print process.

Additionally, it is possible to realize the invention in various aspects, and for example, the invention can be realized in forms such as a printing method and a printing apparatus, a control method of a printing apparatus and a control apparatus, a computer program for realizing these methods or the functions of these apparatuses, a recordable medium on which the abovementioned computer program is recorded.

BRIEF DESCRIPTION OF THE DRAWINGS

The invention will be described with reference to the accompanying drawings, wherein like numbers reference like elements.

DESCRIPTION OF EXEMPLARY EMBODIMENTS

Next, aspects of the invention will be described in the following order on the basis of embodiments.

A. First Embodiment
A-1. Configuration of the Printing Apparatus
A-2. Printing Process
B. Second Embodiment
C. Modification Examples

A. First Embodiment

A-1. Configuration of the Printing Apparatus

Figure 1:
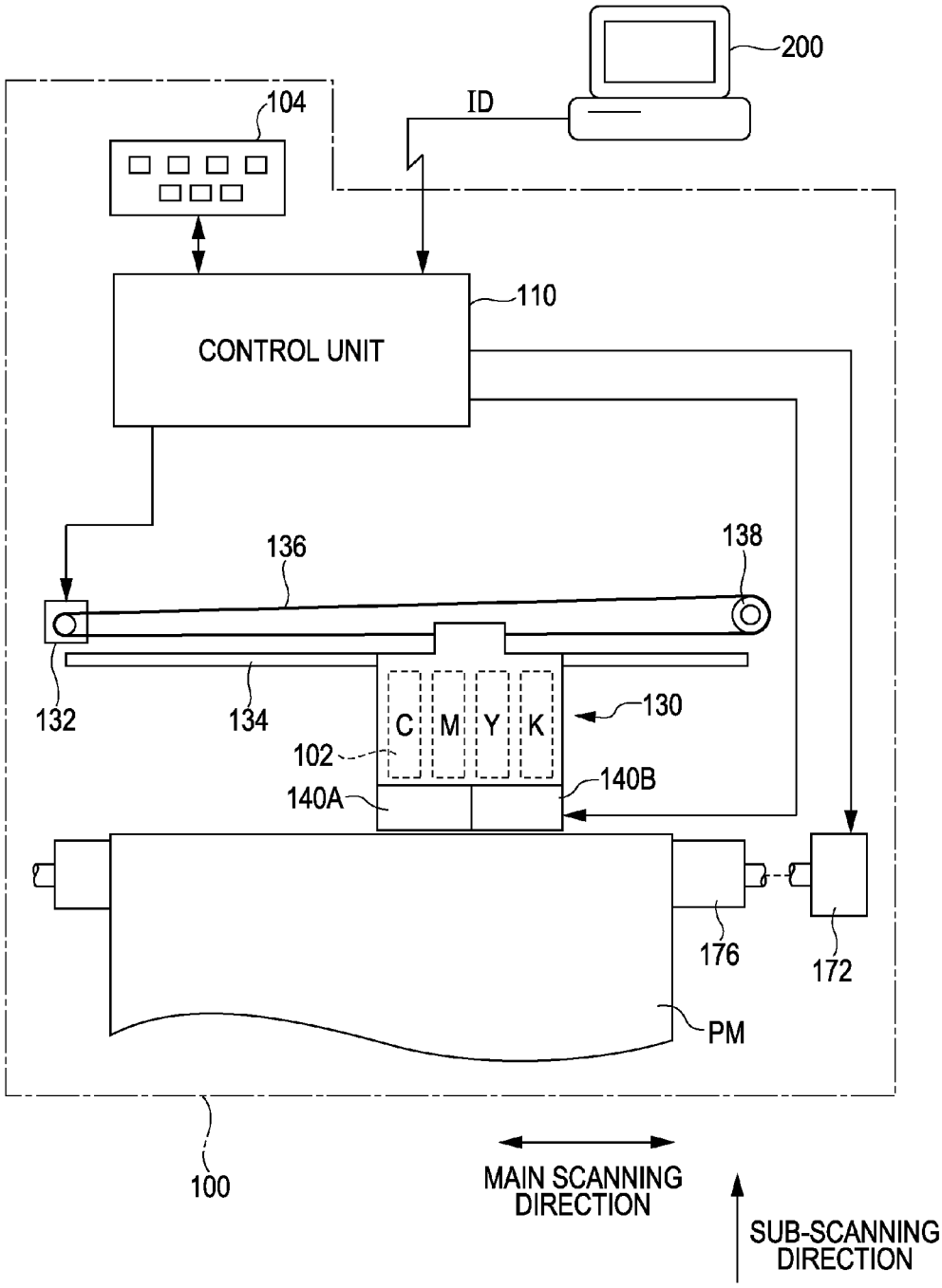
FIG. 1 is an explanatory drawing that shows a schematic configuration of a printing apparatus 100 in a first embodiment of the invention.

FIG. 1 is an explanatory drawing that shows a schematic configuration of a printing apparatus 100 in the first embodiment of the invention. The printing apparatus 100 of the present embodiment is an ink jet printer that forms ink dot groups on a print medium PM by discharging ink, and as a result of this, prints images (including characters, diagrams and the like) depending on image data ID supplied from a host computer 200.

As shown in FIG. 1, the printing apparatus 100 is provided with a carriage 130 in which two print heads 140 (a first print head 140A and a second print head 140B) are mounted, a movement mechanism that causes the carriage 130 to reciprocate along a direction (main scanning direction) that is parallel to the axis of a platen 176, a transport mechanism that performs a sub-scan that transports the print medium PM in a direction (sub-scanning direction) that is orthogonal to the main scanning direction, an operation panel 104 that receives various instructions and setting operations that are related to printing, and a control unit 110 that controls each section of the printing apparatus 100. The carriage 130 that has the print heads 140 is connected to the control unit 110 through a flexible flat cable (FFC) which is not shown in the drawing. Additionally, provided the sub-scanning direction is a direction that intersects the main scanning direction, the sub-scanning direction need not necessarily be a direction that is orthogonal to the main scanning direction. In the following description, there are cases in which the first print head 140A and the second print head 140B are referred to collectively as the print heads 140.

The transport mechanism that transports the print medium PM has a paper transfer motor 172. The rotation of the paper transfer motor 172 is transmitted to a print medium transport roller (not shown in the drawing) via a gear train (also not shown in the drawing), and the print medium PM is transported along the sub-scanning direction as a result of the rotation of the print medium transport roller. Additionally, as a sub-scan, a sliding axis (guide member) 134 may be moved in the sub-scanning direction in place of the print medium PM being transported, or in addition to the print medium PM being transported. That is, a sub-scan is an operation that moves the print medium PM relatively with respect to the sliding axis (guide member) 134 in the sub-scanning direction.

The movement mechanism that reciprocates the carriage 130 along the main scanning direction has a carriage motor 132, the sliding axis (guide member) 134 that is installed parallel to the axis of the platen 176 (that is, in the main scanning direction) and slidably retains the carriage 130, and a pulley 138 on which an endless drive belt 136 is stretched between the carriage motor 132 and the pulley 138. The rotation of the carriage motor 132 is transmitted to the carriage 130 through the drive belt 136, and as a result of this, the carriage 130 in which the two print heads 140 are mounted reciprocates along the sliding axis 134. In addition, the movement mechanism that reciprocates the carriage 130 controls the rotation of the carriage motor 132, and it is possible to stop the carriage 130 at a desired position along the main scanning direction. Hereinafter, one direction along the main scanning direction (a direction of moving from the home position of the carriage 130 toward the opposite side) is also referred to as a main scanning travel direction and the other direction (the opposite direction to the main scanning travel direction) is also referred to as the main scanning return direction. Additionally, in order to detect the position along the main scanning direction of the carriage 130, the printing apparatus 100 is provided with an encoder (not shown in the drawing) that outputs a pulsed signal that accompanies the rotation of the carriage motor 132 to the control unit 110. The control unit 110 generates a timing signal PTS, which defines the input timing of drive signal selection signals SI and SP to a shift register 162 that will be described later, on the basis of the pulsed signal output from the encoder.

A set of ink cartridges 102, in which ink of predetermined colors (for example, cyan (C), magenta (M), yellow (Y) and black (K)) is respectively accommodated, are detachably mounted to the carriage 130. The ink that is accommodated in the set of ink cartridges 102 mounted to the carriage 130 is supplied to the first print head 140A and the second print head 140B.

Since the first print head 140A and the second print head 140B are mounted to the carriage 130, the first print head 140A and the second print head 140B reciprocate along the main scanning direction in a state that accompanies the movement of the carriage 130 and in which the positional relationship thereof is fixed.

Figure 2A:
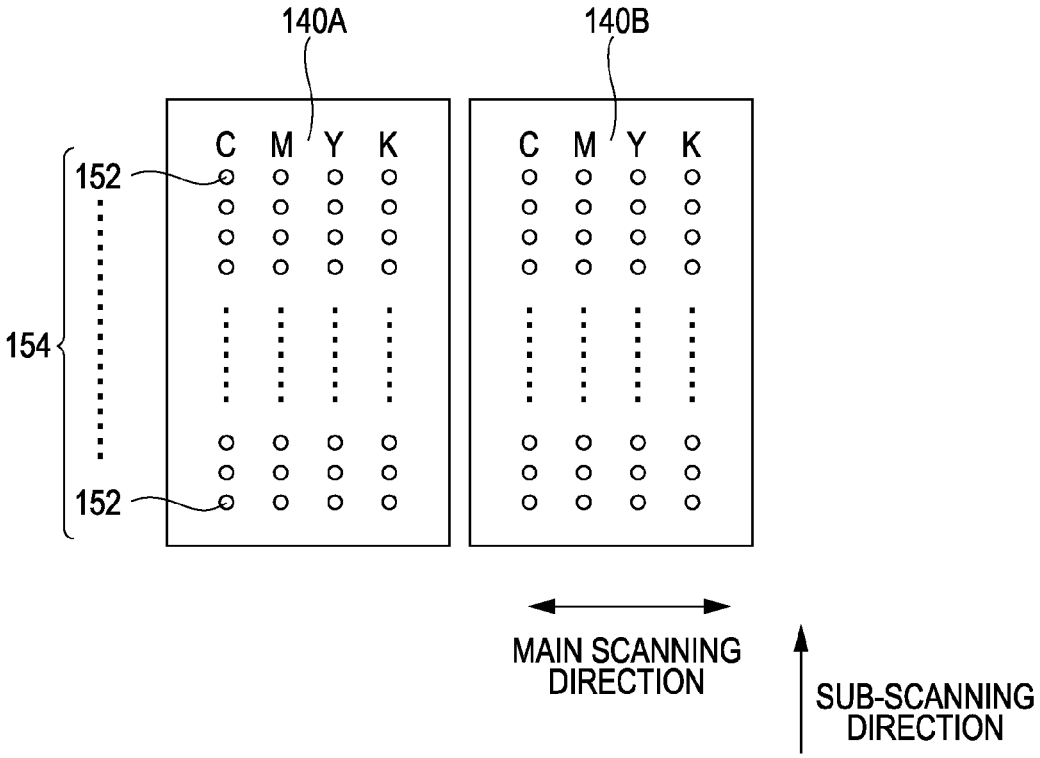
FIGS. 2A and 2B are explanatory drawings that show the configuration of a nozzle formation surface of each print head 140.
Figure 2B:
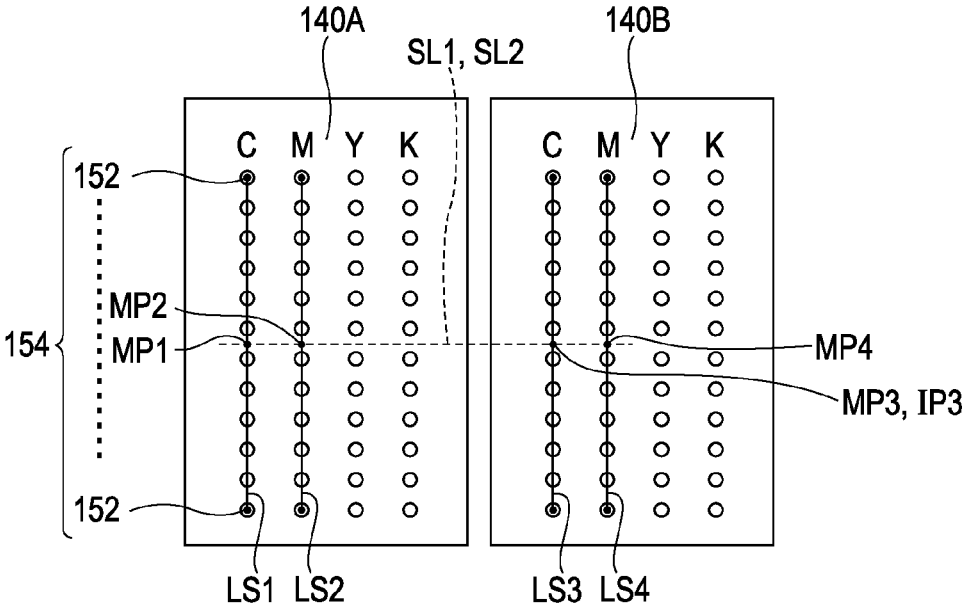

Each print head 140 has a plurality of nozzles 152 that discharge ink at a surface (nozzle formation surface) that faces the platen 176. FIGS. 2A and 2B are explanatory drawings that show the configuration of a nozzle formation surface of each print head 140. As shown in FIG. 2A, the plurality of nozzles 152 are formed in the respective nozzle formation surfaces of the first print head 140A and the second print head 140B. In the respective print heads 140, the plurality of nozzles 152 configure a plurality of nozzle rows 154 (cyan nozzle row, magenta nozzle row, yellow nozzle row and black nozzle row) that are lined up along the main scanning direction. Each nozzle row 154 is configured from a plurality of nozzles 152 that are disposed lined up along the sub-scanning direction. Additionally, it is not necessary for the plurality of nozzles 152 that configure each nozzle row 154 to be disposed lined up in linear form along the sub-scanning direction, and for example, the foregoing may be disposed lined up in a zigzag form along the sub-scanning direction.

One ink (for example, set as cyan ink in this instance) from among the cyan ink, magenta ink and yellow ink in the embodiment corresponds to the first chromatic ink in the claims and a different ink (for example, set as magenta ink in this instance) from among the cyan ink, magenta ink and yellow ink corresponds to the second chromatic ink in the claims. In addition, a nozzle row 154 for the ink (cyan ink) that corresponds to the abovementioned first chromatic ink in the first print head 140A corresponds to the first nozzle row in the claims, a nozzle row 154 for the ink (magenta ink) that corresponds to the abovementioned second chromatic ink in the first print head 140A corresponds to the second nozzle row in the claims, a nozzle row 154 for the ink (cyan ink) that corresponds to the abovementioned first chromatic ink in the second print head 140B corresponds to the third nozzle row in the claims, and a nozzle row 154 for the ink (magenta ink) that corresponds to the abovementioned second chromatic ink in the second print head 140B corresponds to the fourth nozzle row in the claims.

In the embodiment, the positions along the sub-scanning direction of each nozzle row 154 are the same in each print head 140. That is, in each print head 140, the positions of each nozzle row 154 overlap in the main scanning direction. In addition, in the embodiment, the positions along the sub-scanning direction of each nozzle row 154 of the first print head 140A and the positions along the sub-scanning direction of each nozzle row 154 of the second print head 140B are the same. That is, in the embodiment the positions along the sub-scanning direction of all of the nozzle rows 154 formed on the two print heads 140 are the same. Therefore, in the embodiment, as shown in FIG. 2B, a first straight line SL1, which links a central point MP1 of a first line segment LS1 that links the nozzles 152 of both ends of the first nozzle row (set as the cyan ink nozzle row 154 of the first print head 140A in this instance) and a central point MP2 of a second line segment LS2 that links the nozzles 152 of both ends of the second nozzle row (set as the magenta ink nozzle row 154 of the first print head 140A in this instance), crosses a third line segment LS3 that links the nozzles 152 of both ends of the third nozzle row (set as the cyan ink nozzle row 154 of the second print head 140B in this instance) and a fourth line segment LS4 that links the nozzles 152 of both ends of the fourth nozzle row (set as the magenta ink nozzle row 154 of the second print head 140B in this instance). In addition, the second straight line SL2, which links a central point MP3 of the third line segment LS3 and a central point MP4 of the fourth line segment LS4, crosses the first line segment LS1 and the second line segment LS2. Furthermore, the distance (=zero) between an intersection IP3 of the first straight line SL1 and the third line segment LS3 and the central point MP3 of the third line segment LS3 is shorter than the distance (=half the length of the third line segment LS3) between the intersection IP3 and an end point on the near side of the third line segment LS3.

In addition, each print head 140 has a nozzle actuator 156 (refer to FIGS. 3 and 5) that is provided to correspond to each nozzle 152. In the embodiment, a piezoelectric element that is a capacitive load may be used as the nozzle actuator 156. When a nozzle actuator 156 is driven by a drive signal that will be described later, a vibration plate inside a cavity (pressure chamber) that communicates with a nozzle 152 is displaced giving rise to a change in the pressure inside the cavity, and ink is discharged from the corresponding nozzle 152 as a result of this change in pressure. By adjusting the peak value and the degree of the increase and decrease in voltage inclination of the drive signal used to drive the nozzle actuator 156, it is possible to adjust the amount of the ink discharge (that is, the size of dot that is formed). Images are formed on the print medium PM by ink being discharged from the nozzles 152 of each print head 140. Additionally, since the printing apparatus 100 is an ink jet printer that forms ink dot groups on a print medium PM by discharging ink and prints images as a result of this, it is also possible to refer to an "image" as an "ink dot group". A dot group formed by the first print head 140A in the embodiment corresponds to the first dot group in the claims and a dot group formed by the second print head 140B in the embodiment corresponds to the second dot group in the claims.

Figure 3:
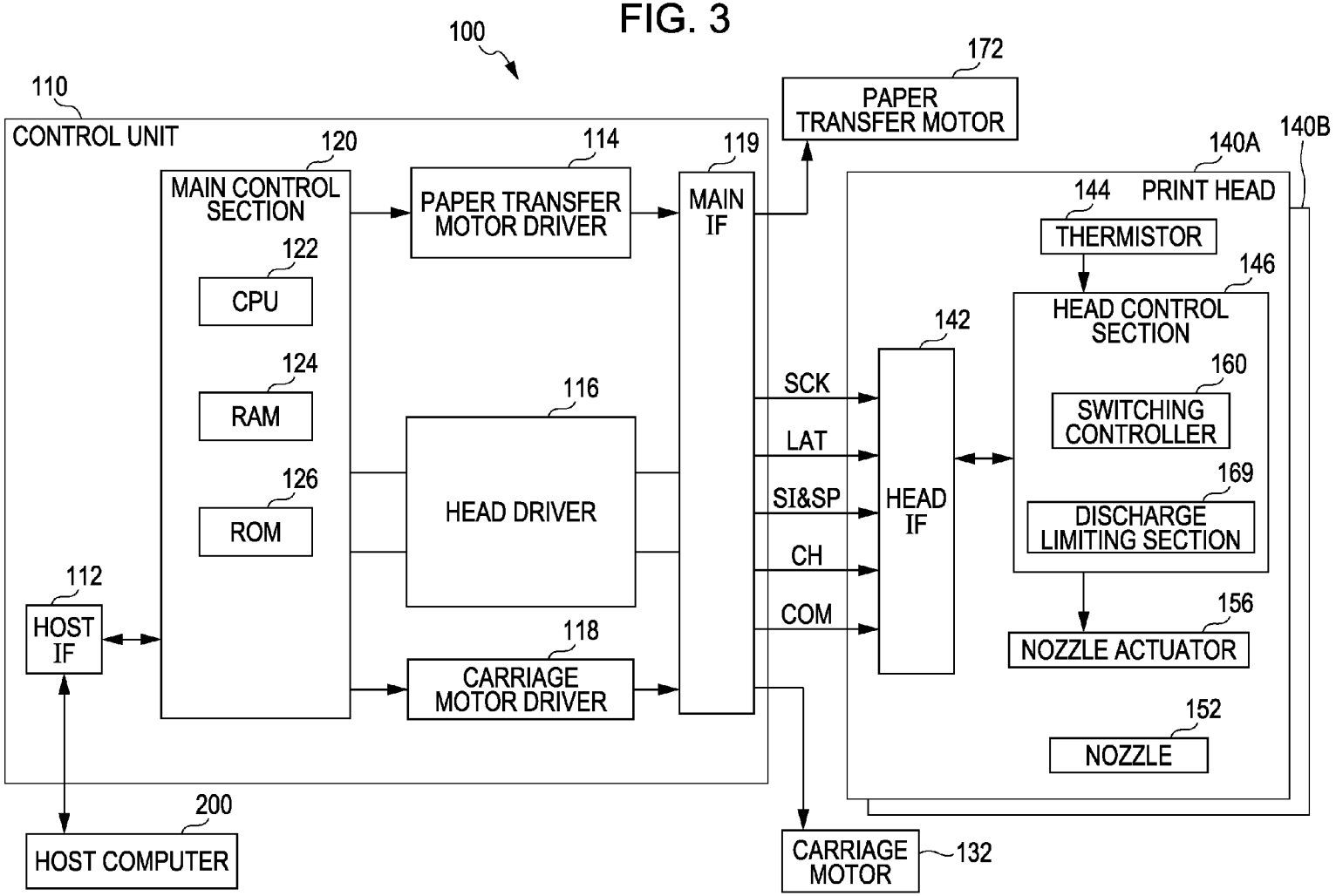
FIG. 3 is an explanatory drawing that shows a schematic configuration of the printing apparatus 100 focusing on a control unit 110 and print heads 140.

FIG. 3 is an explanatory drawing that shows a schematic configuration of the printing apparatus 100 focusing on the control unit 110 and print heads 140. The control unit 110 has a host interface (IF) 112 for the input of image data ID or the like from the host computer 200, a main control section 120 that executes a predetermined calculation process for the printing of images on the basis of the image data ID input through the host interface 112, a paper transfer motor driver 114 that controls the driving of the paper transfer motor 172, a head driver 116 that controls the driving of each print head 140, a carriage motor driver 118 that controls the driving of the carriage motor 132 and a main interface (IF) 119 that is respectively connected to each driver 114, 116 and 118, the paper transfer motor 172, the print heads 140 and the carriage motor 132.

The main control section 120 includes a CPU 122 that executes various calculation processes, a RAM 124 that temporarily stores and deploys programs and data, and a ROM 126 that stores programs and the like that the CPU 122 executes. The various functions of the main control section 120 are realized by the CPU 122 reading and executing the programs stored in the ROM 126 in the RAM 124. Additionally, the main control section 120 may be provided with an electric circuit, at least a portion of the functions of the main control section 120 may be realized through the electric circuit with which the main control section 120 is provided operating on the basis of the circuit configuration thereof.

When image data ID from the host computer 200 is acquired through the host interface 112, the main control section 120 generates nozzle selection data (drive signal selection data), which defines whether or not to discharge ink and the amount of ink to discharge from a certain nozzle 152 of each print head 140, by performing calculation processes for printing execution such as an image development process, a color conversion process, an ink color classification process and a halftone process on the basis of the image data ID, and outputs control signals to each driver 114, 116 and 118 on the basis of the drive signal selection data and the like. Additionally, since the contents of the various calculation processes for printing execution that the main control section 120 executes are well-known matters in the technical field of printing apparatuses, the description thereof has been omitted. Each driver 114, 116 and 118 outputs drive signals for respectively driving the paper transfer motor 172, each print head 140 and the carriage motor 132. For example, the head driver 116 supplies a reference clock signal SCK, a latch signal LAT, drive signal selection signals SI and SP, a channel signal CH and a drive signal COM that will be described later to each print head 140. Each print head 140 (the first print head 140A and the second print head 140B) has a head interface (IF) 142, a thermistor 144 that detects the temperature of the print head 140, a head control section 146 that is configured from an electric circuit, the abovementioned plurality of nozzles 152 and a nozzle actuator 156 that drives the nozzles 152. The head control section 146 includes a switch controller 160 and a discharge limiting section 169. Ink discharge from the nozzles 152 is executed by the switch controller 160 operating on the basis of the various signals input from the control unit 110 through the head interface 142. Additionally, either a portion of or all of the functions of the head control section 146 may be realized using software. The paper transfer motor 172 and the carriage motor 132 operate depending on the drive signal supplied from the control unit 110. As a result of this, a print process that forms images on the print medium PM is realized.

Figure 4:
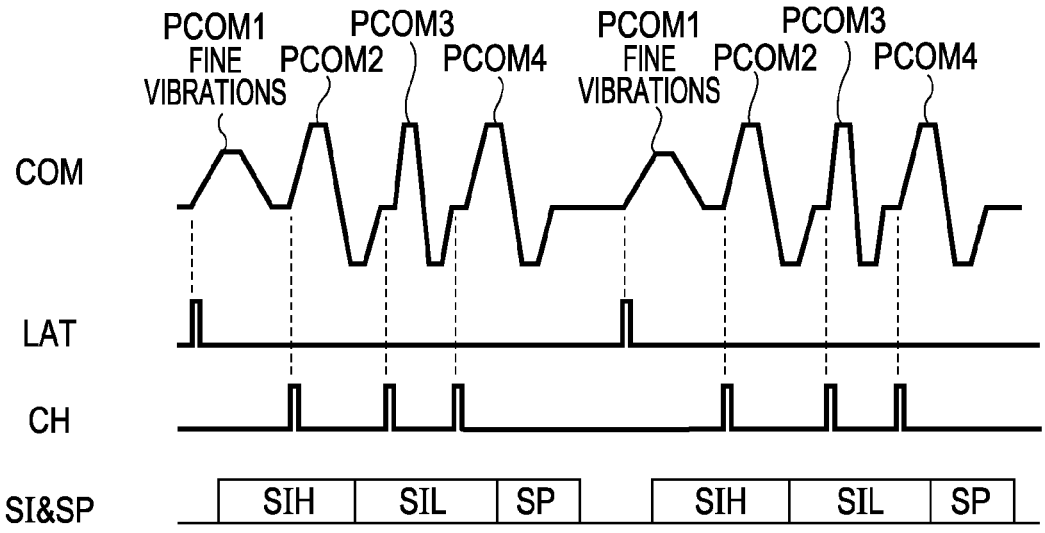
FIG. 4 is an explanatory drawing that shows an example of various signals that are supplied to each print head 140.

FIG. 4 is an explanatory drawing that shows an example of various signals that are supplied to each print head 140. The drive signal COM is for driving the nozzle actuators 156 provided in each print head 140. The drive signal COM is a signal in which drive pulses PCOM (drive pulses PCOM1 to PCOM4) are continued in time series as the minimum units (unit drive signals) of the drive signal that drives the nozzle actuators 156. The set of the four drive pulses PCOM from the drive pulse PCOM1 to PCOM4 correspond to one pixel (printing pixel).

Each drive pulse PCOM is configured by a voltage trapezoidal wave. The rise of each drive pulse PCOM increases the capacity of the cavity that communicates with the nozzle 152 and draws ink in (it could be said that the meniscus is drawn in if considered in terms of the discharge surface of the ink), and the fall of each drive pulse PCOM decreases the capacity of the cavity and pushes ink out (it could be said that the meniscus is pushed out if considered in terms of the discharge surface of the ink). Therefore, ink is discharged from the nozzles 152 by driving the nozzle actuator 156 according to the drive pulses PCOM.

In the drive signal COM, the waveforms (the degrees of the increase and decrease in voltage inclination and the peak values) of the drive pulses PCOM2 to PCOM4 are mutually different. When the waveforms of the drive pulses PCOM that are supplied to the nozzle actuators 156 are different, the amount by which the ink is drawn in and the speed thereof and the amount by which the ink is pushed out and the speed thereof differ, and the amount of the ink discharge (that is, the size of an ink dot) differs as a result thereof. By selecting either one or a plurality of drive pulses PCOM from among the drive pulses PCOM2 to PCOM4 and supplying the selected drive pulses to the nozzle actuators 156, it is possible to form ink dots of various sizes. Additionally, in the embodiment, the drive pulse PCOM1, which is referred to as a fine vibration, is included in the drive signal COM. The drive pulse PCOM1 is used in cases in which ink is only drawn in and not pushed out, for example, a case of suppressing nozzle thickening.

The drive signal selection signals SI and SP determine the connection timing of the nozzle actuators 156 to the drive signal COM in addition to selecting the nozzles 152 that discharge ink. The latch signal LAT and the channel signal CH connect the drive signal COM and the nozzle actuators 156 of each print head 140 on the basis of the drive signal selection signals SI and SP after nozzle selection data has been input for all of the nozzles 152. As shown in FIG. 3, the latch signal LAT and the channel signal CH is synchronized with the drive signal COM. That is, the latch signal LAT becomes a high level in correspondence with the start timing of the drive signal COM, and the channel signal CH becomes a high level in correspondence with the start timing of each drive pulse PCOM that configures the drive signal COM. The output of a successive the drive signal COM is started depending on the latch signal LAT, and each drive pulse PCOM is output depending on the channel signal CH. In addition, the reference clock signal SCK sends the drive signal selection signals SI and SP to each print head 140 as serial signals. That is, the reference clock signal SCK is used in the determination of the timing with which ink is discharged from the nozzles 152 of each print head 140.

Figure 5:
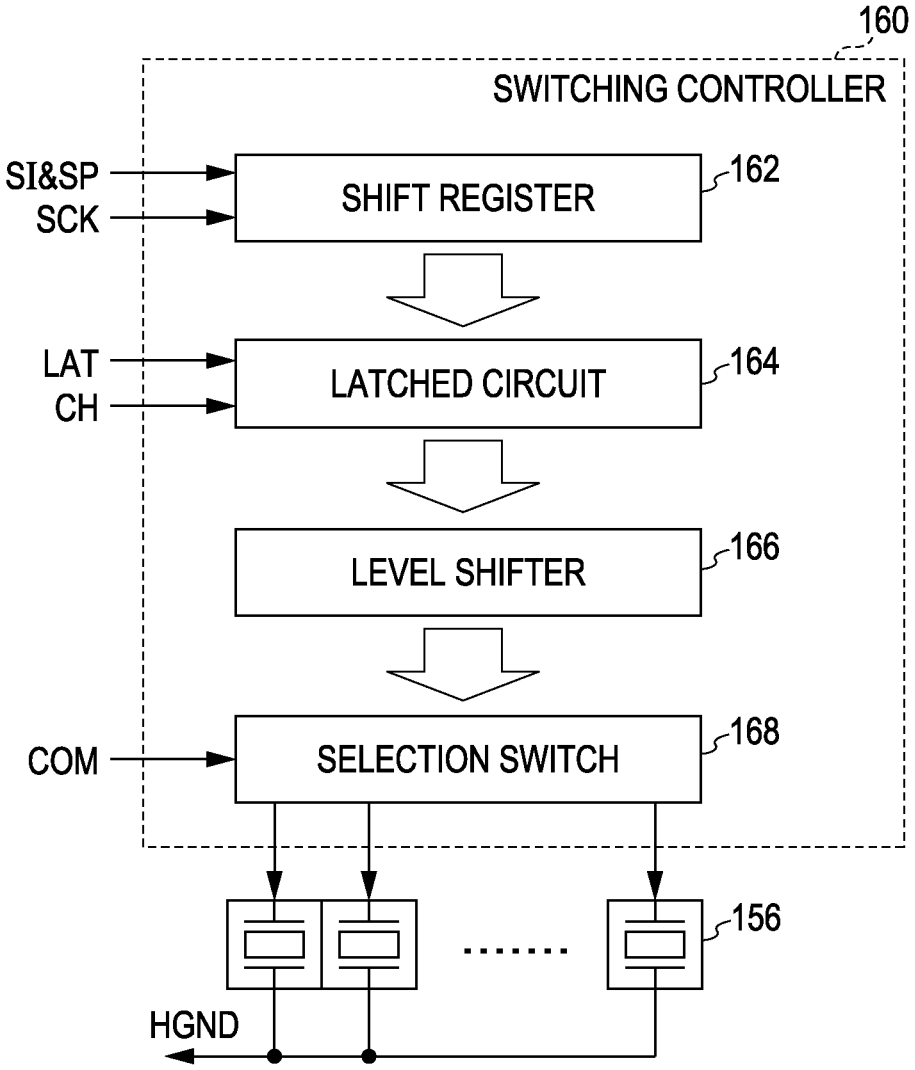
FIG. 5 is an explanatory drawing that shows the configuration of a switching controller 160 of each print head 140.

FIG. 5 is an explanatory drawing that shows the configuration of a switching controller 160 of each print head 140. The switch controller 160 is assembled inside the head control section 146 of each print head 140 in order to supply the drive signals COM (drive pulses PCOM) to the nozzle actuators 156. The switch controller 160 has a shift register 162 that saves the drive signal selection signals SI and SP, a latch circuit 164 that temporarily saves the data of the shift register 162, a level shifter 166 that level converts the output of the latch circuit 164 and supplies the converted output to a selection switch 168 and the selection switch 168 that connects the drive signal COM to the nozzle actuators 156.

The drive signal selection signals SI and SP are sequentially input to the shift register 162, and the area in which the drive signal selection signals SI and SP are stored is sequentially shifted to a subsequent stage depending on the input pulse of the reference clock signal SCK. Additionally, the input of the drive signal selection signals SI and SP to the shift register 162 is executed in accordance with the abovementioned timing signal PTS. The latch circuit 164 latches each output signal of the shift register 162 in accordance with the input latch signal LAT after drive signal selection signals SI and SP equal to the number of nozzles have been stored in the shift register 162. The signal saved in the latch circuit 164 is converted into a voltage level that can switch (on/off) the selection switch 168 of the next stage by the level shifter 166. A nozzle actuator 156 that corresponds to a selection switch 168 that is closed (enters a connected state) by the output signal of the level shifter 166 is connected to the drive signal COM (drive pulses PCOM) using the connection timing of the drive signal selection signals SI and SP. In addition, after the drive signal selection signals SI and SP that are input into the shift register 162 have been latched by the latch circuit 164, subsequent drive signal selection signals SI and SP are input into the shift register 162, and the save data of the latch circuit 164 is sequentially updated in conformity with the timing of ink discharge. According to this selection switch 168, even after the nozzle actuator 156 has been isolated from the drive signal COM (drive pulses PCOM), the input voltage of the nozzle actuator 156 is retained as a voltage immediately before isolation. Additionally, the symbol HGND in FIG. 5 is a ground end of the nozzle actuator 156.

Figure 6:
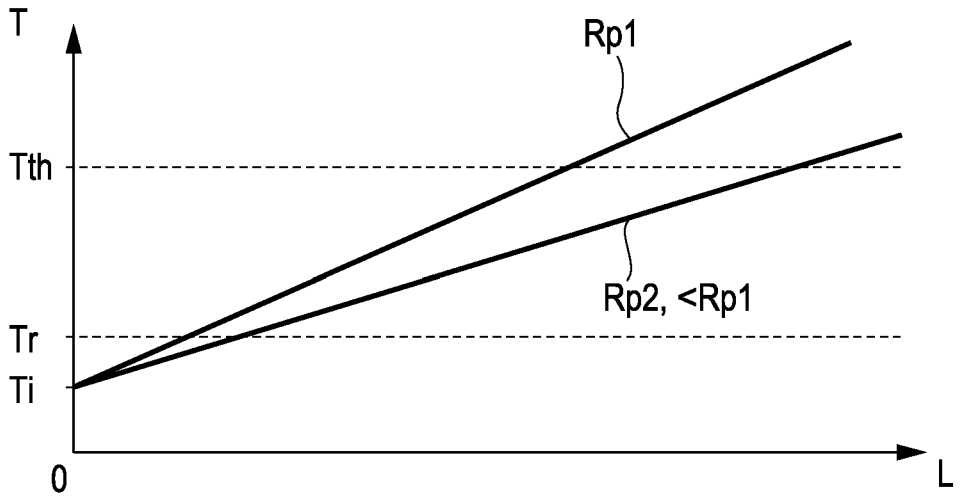
FIG. 6 is an explanatory drawing that shows the relationship between the ink discharge operation of the print head 140 and the temperature T of the print head 140 on a conceptual basis.

As described above, the print heads 140 have a thermistor 144 (FIG. 3) that detects the temperature of the print heads 140, and the discharge limiting section 169 of the head control section 146 limits the ink discharge operation from the nozzles 152 on the basis of the temperature detected by the thermistor 144. FIG. 6 is an explanatory drawing that shows the relationship between the ink discharge operation of the print head 140 and the temperature T of the print head 140 on a conceptual basis. In FIG. 6, the relationship between the distance L from a starting position to the position of the carriage 130 and the temperature T of the first print head 140A in a case in which the ink discharge operation is continuously executed at a specific print resolution Rp (a print resolution Rp1 or a print resolution Rp2 that is lower that the print resolution Rp1) while moving the carriage 130 in which the first print head 140A is mounted along the main scanning direction from one end (starting position) of the print medium PM toward the other end (a case in which the ink discharge operation is executed in all of the printing pixels established by the print resolution Rp), is shown on a conceptual basis. During periods in which the ink discharge operation from the nozzles 152 is being executed, the temperature of the first print head 140A rises as a result of heat being generated from the various elements and drive circuits including the nozzle actuators 156. Therefore, as shown in FIG. 6, from an initial temperature Ti of the starting position (a normal temperature when a sufficient amount of time has passed since the completion of the ink discharge operation), the temperature of the first print head 140A rises as the distance L, which the ink discharge operation has been continuously executed for, increases. On the other hand, during periods in which the ink discharge operation is not being executed, the temperature of the first print head 140A falls toward the initial temperature Ti. In a case in which the movement speed of the carriage 130 is fixed so that the gradient of a straight line that corresponds to the print resolution Rp1 is greater than the gradient of a straight line that corresponds to the print resolution Rp2 as in FIG. 6, the ratio of the increase in temperature T to distance L increases by the extent to which the print resolution Rp is a high resolution. Additionally, in the embodiment, since the first print head 140A and the second print head 140B are the same (same model number) print head, the temperature characteristics of the second print head 140B are also the same as the characteristics shown in FIG. 6. In addition, in FIG. 6, the relationship between the distance L and the temperature T is conveniently expressed in linear form, but the relationship between the distance L and the temperature T differs as a result of the configuration of the print heads 140 and the movement speed of the carriage 130, and thus there are cases in which the relationship cannot necessarily be expressed in linear form.

In the embodiment, an upper temperature limit Tth, at which correct operation of the print heads 140 is guaranteed, is set in advance. The upper temperature limit Tth is determined on the basis of the heatproof temperatures of each component (each element and circuit) that configures the print heads 140, the heatproof temperatures of the adhesives that are used in the assembly of each component and the like. The discharge limiting section 169 (FIG. 3) of the print heads 140 limits the ink discharge operation from the nozzles 152 so that the temperature of the print heads 140 does not exceed the upper temperature limit Tth. More specifically, when the temperature of the print heads 140 that is detected by the thermistor 144 reaches the upper temperature limit Tth, the discharge limiting section 169 changes the drive signal selection signals SI and SP, which are supplied from the control unit 110 and select the ink discharge nozzles, to signals that represent that ink should not be discharged from any of the nozzles. As a result of this, regardless of the contents of the drive signal selection signals SI and SP that are supplied from the control unit 110, the ink discharge operation from the nozzles 152 is stopped, and the temperature of the print heads 140 falls. After the limiting of the ink discharge operation has started, when the temperature of the print heads 140 that is detected by the thermistor 144 has fallen to a predetermined recovery temperature Tr (FIG. 6), the discharge limiting section 169 releases the limiting of the ink discharge operation. The recovery temperature Tr is set in advance to be in a range that is greater than or equal to the initial temperature Ti and less than the upper temperature limit Tth. The recovery temperature Tr may be the same as the initial temperature Ti. As a result of the ink discharge operation limitation according to this kind of discharge limiting section 169, it is possible to avoid the occurrence of breakdowns that result from excessive temperature increases of the print heads 140 and printing defects which accompany the destabilization of ink discharge. In addition, it is possible to avoid situations in which the loads that are applied to the components for the discharge operation such as the nozzle actuators 156 are excessive, and shortening of the component life is suppressed. Additionally, the ink discharge operation limitation according to the discharge limiting section 169 need not necessarily be executed according to a method that uses the temperature detection result of the thermistor 144, and may be executed according to any other method provided it is a method that avoids an ink discharge operation in which the temperature of the print heads 140 exceeds the upper temperature limit Tth.

A-2. Printing Process

Figure 7:
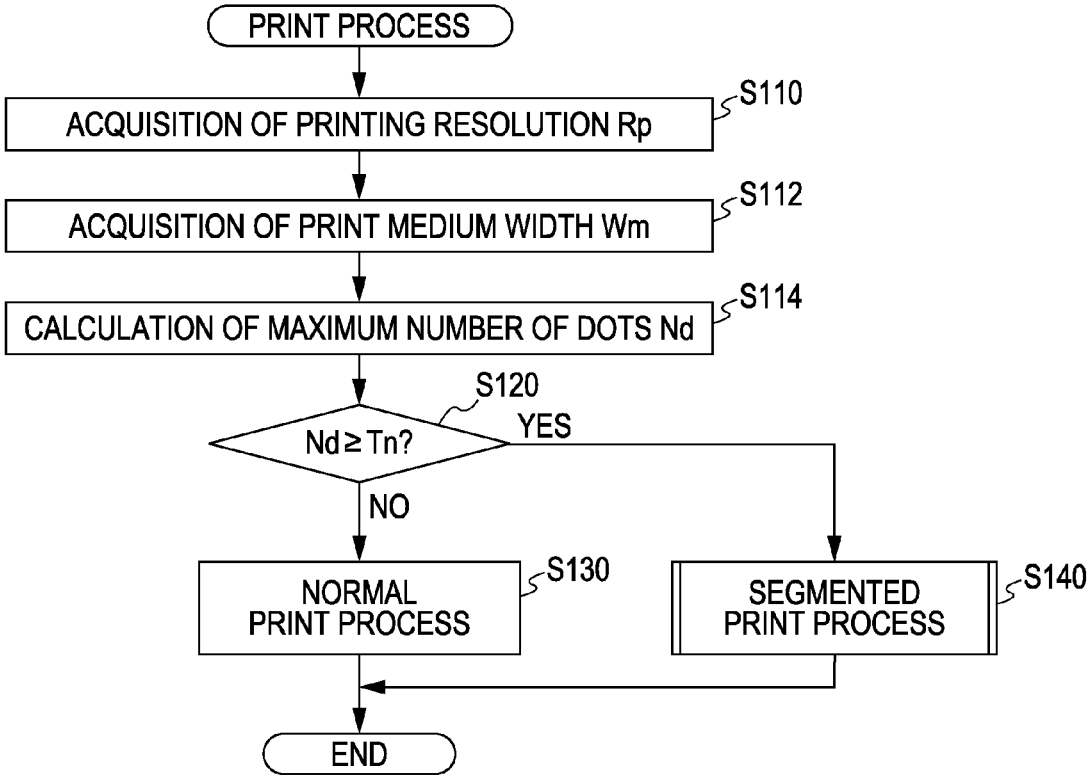
FIG. 7 is a flowchart that shows the flow of a print process of the printing apparatus 100.

FIG. 7 is a flowchart that shows the flow of a print process of the printing apparatus 100. The print process of the printing apparatus 100 forms images depending on image data ID on a print medium PM on the basis of image data ID input from the host computer 200 under the control of the main control section 120.

Firstly, the main control section 120 (FIG. 3) of the printing apparatus 100 acquires the print resolution Rp at the time of the print process (Step S110) in addition to acquiring a width Wm along the main scanning direction of the print medium PM to be used in the print process (Step S112). The print resolution Rp and the print medium width Wm are acquired on the basis of information included in a print instruction of the host computer 200.

Next, the main control section 120 calculates a maximum number of dots Nd of one raster (a dot row configured by a plurality of dots lined up along the main scanning direction) (Step S114). The maximum number of dots Nd is, with respect to each ink color, the number of dots that configure one raster that is formed in a case in which a dot is formed in all of the print pixels along the main scanning direction. In the embodiment, since the print resolution Rp is set as the same value for each ink color, the maximum number of dots Nd for each of the ink colors is the same, and is calculated by multiplying the print resolution Rp by the print medium width Wm. For example, in a case in which the size of the print medium PM is A3 (a width of approximately 11.69 inches) and the print resolution Rp is 300 dpi, the maximum number of dots Nd is 11.69×300=approximately 3507 dots. In cases in which the maximum number of dots Nd is large due to the size of the print medium PM being large or the print resolution Rp being a high resolution, when a raster is formed using one print head 140, depending on the image data ID, there is a concern that the temperature of the print head 140 will reach the upper temperature limit Tth.

Next, the main control section 120 determines whether or not the calculated maximum number of dots Nd is greater than or equal to a predetermined threshold value Tn (Step S120). The threshold value Tn is set as a value that is smaller than the number of dots that it takes for the temperature of the print head 140 to reach the upper temperature limit Tth in a case in which a raster is formed by continuously discharging ink along the main scanning direction from the nozzles 152 of one print head 140 while moving the carriage 130 at a predetermined speed. In the embodiment, the threshold value Tn is 3500, and thus is a value that is slightly less than the maximum number of dots Nd in a case in which the size of the print medium PM is A3 and the print resolution Rp is 300 dpi (approximately 3507).

In a case in which the maximum number of dots Nd is below the threshold value Tn (Step S120: NO), even if a raster is formed using the nozzles 152 of one print head 140, the temperature of the print heads 140 does not reach the upper temperature limit Tth. In this case, the main control section 120 executes a normal print process (Step S130). For example, in a case in which the size of the print medium PM is A4 (a width of approximately 8.27 inches) and the print resolution Rp is 300 dpi or a case in which the size of the print medium PM is A3 and the print resolution Rp is 150 dpi, since the maximum number of dots Nd is below the threshold value Tn, a normal print process is performed.

A normal print process is a process in which images depending on image data ID are printed on the print medium PM by repeating an operation of forming images on the print medium PM by executing an ink discharge operation depending on image data ID using the first print head 140A while continuously moving the carriage 130 in the main scanning travel direction (main scan), a home position return operation of moving the carriage 130 to the home position in the main scanning return direction without performing ink discharge, and a transport operation of the print medium PM in the sub-scanning direction (sub-scan). In the normal print process, an ink discharge operation (image formation operation) using the second print head 140B is not executed. Therefore, all of the plurality of dots that configure each raster (dot row) in images formed using the normal print process are formed by the first print head 140A, and dots formed by the second print head 140B are not included. That is, in each raster, the number of dots that are included in the second dot group is zero.

Additionally, in the normal print process of the embodiment, image formation on a unit band area (an area with a width along the main scanning direction that is the entire width Wm of the print medium PM and a length along the sub-scanning direction that is the length of the nozzle row of the print head 140) is completed in a single image formation operation. Therefore, the transport amount of the print medium PM in the sub-scanning direction is an amount that is equal to the length of the nozzle row.

As described above, since the threshold value Tn is set as a value that is smaller than the number of dots that it takes for the temperature of the print head 140 to reach the upper temperature limit Tth in a case in which dots are formed continuously along the main scanning direction using one print head 140, in a case in which the maximum number of dots Nd is below the threshold value Tn, even if the image formation operation is performed using the first print head 140A while continuously moving the carriage 130 in the main scanning travel direction across the entire print medium width Wm, the temperature of the first print head 140A does not reach the upper temperature limit Tth. In addition, since the ink discharge operation is not performed in periods in which the home position return operation and the transport operation are executed, the temperature of the first print head 140A falls. Therefore, even if a normal print process such as that described above is performed, it is possible to complete image formation on the entire print medium PM while avoiding the occurrence of a situation in which the temperature of the first print head 140A exceeds the upper temperature limit Tth.

Figure 8:
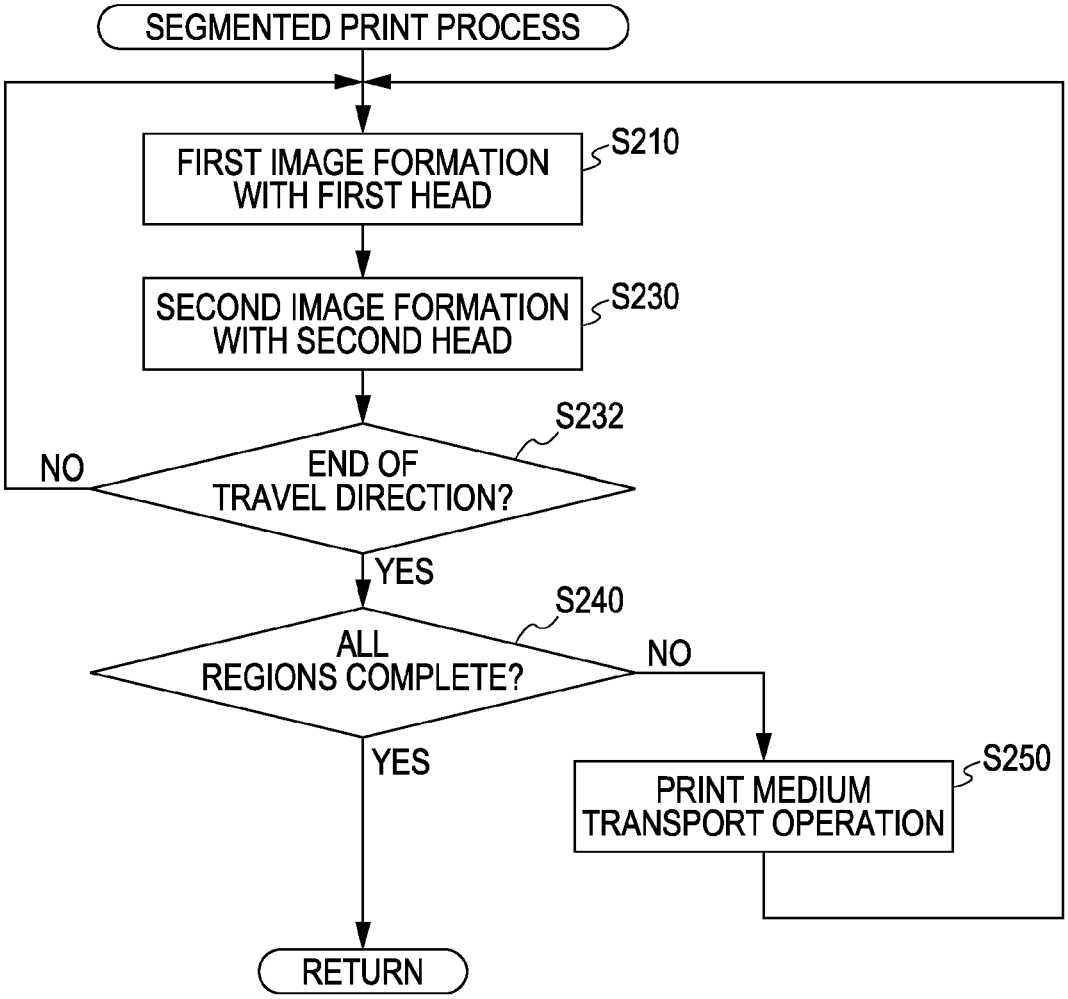
FIG. 8 is a flowchart that shows the flow of a divided print process.
Figure 9A:
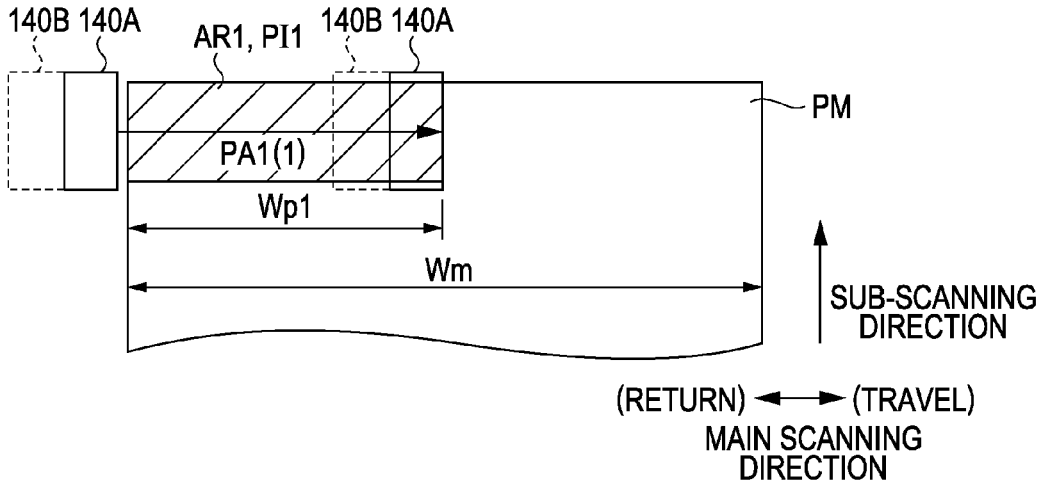
FIGS. 9A, 9B and 9C are explanatory drawings that show a summary of the divided print process.
Figure 9B:
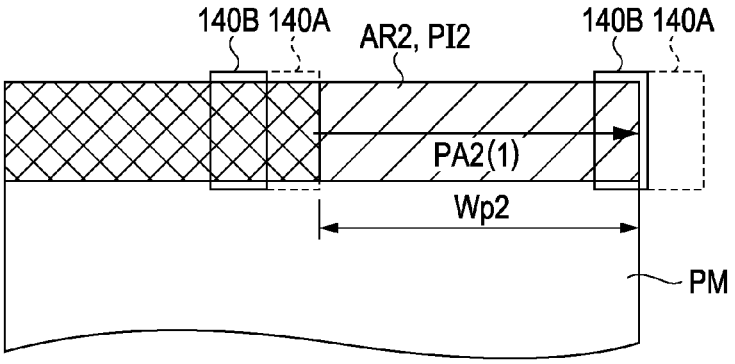
Figure 9C:
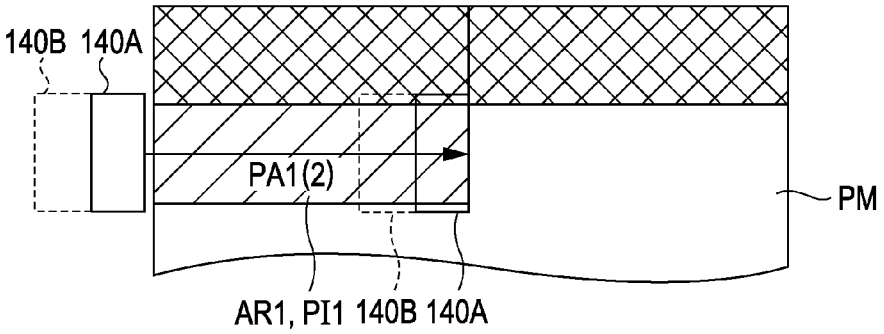

On the other hand, in a case in which the maximum number of dots Nd is greater than or equal to the threshold value Tn (Step S120: YES), there is a concern that, depending on image data ID, the temperature of the print head 140 will reach the upper temperature limit Tth if a raster is formed using the nozzles 152 of one print head 140. In this case, the main control section 120 executes a divided print process (Step S140). FIG. 8 is a flowchart that shows the flow of a divided print process. In addition, FIGS. 9A to 9C are explanatory drawings that show a summary of the divided print process. In FIGS. 9A to 9C, a print head 140 that is executing the operations illustrated is shown with a solid line and a print head 140 that is not contributing to the operations illustrated is shown with a broken line. In addition, images formed by the operations illustrated are shown with single hatching, and images formed before the operations illustrated are shown with cross hatching. The same applies to similar subsequent drawings.

Firstly, the main control section 120 executes a first image formation operation PA1 of forming first images PI1 in an area AR1 of the print medium PM using the first print head 140A while moving the carriage 130 over a width Wp1 in the main scanning travel direction (main scan) (Step S210). Additionally, in FIG. 9A, a number in brackets "(1)" is shown after the symbol "PA1", but this number in brackets indicates which number unit band area the first image formation operation PA1 corresponds to (the same applies to similar subsequent drawings). In the embodiment, image formation on a portion with a width Wp1 of a unit band area is completed as a result of the first image formation operation PA1. In such a case, the width Wp1 along the main scanning direction of the area AR1 is set so that the number of dots that configure each raster (dot row) of each ink color in the first images PI1 is less than or equal to the threshold value Tn. Therefore, although the temperature of the first print head 140A rises as a result of the first image formation operation PA1, the temperature of the first print head 140A does not reach the upper temperature limit Tth. In addition, since ink discharge using the second print head 140B is not performed at the time of the first image formation operation PA1, the temperature of the second print head 140B does not rise. Additionally, the length along the sub-scanning direction of the area AR1 is the same as the length of the nozzle row of the first print head 140A.

Next, the main control section 120 executes a second image formation operation PA2 of forming second images PI2 in an area AR2 of the print medium PM using the second print head 140B while moving the carriage 130 over a width Wp2 in the main scanning travel direction (main scan) (Step S230). The first image formation operation PA1 and the second image formation operation PA2 are executed continuously without the movement of the carriage 130 being stopped in the interval therebetween. In the embodiment, image formation on a portion with a width Wp2 of a unit band area is completed as a result of the second image formation operation PA2. In such a case, the width Wp2 along the main scanning direction of the area AR2 is set so that the number of dots that configure each raster (dot row) of each ink color in the second images PI2 is less than or equal to the threshold value Tn. Therefore, although the temperature T of the second print head 140B rises as a result of the second image formation operation PA2, the temperature of the second print head 140B does not reach the upper temperature limit Tth. In addition, since ink discharge using the first print head 140A is not performed at the time of the second image formation operation PA2, the temperature of the first print head 140A, which rose as a result of the first image formation operation PA1 falls to the initial temperature Ti. Additionally, the width Wp2 along the main scanning direction of the area AR2 may be the same as the width Wp1 along the main scanning direction of the area AR1, or may differ therefrom. The length along the sub-scanning direction of the area AR2 is the same as the length of the nozzle row of the second print head 140B.

Next, the main control section 120 determines whether or not the carriage 130 has reached the end of the main scanning travel direction side of the print medium PM (Step S232). In a case in which it is determined that the carriage 130 has not reached the end of the main scanning travel direction side of the print medium PM (Step S232: NO), the main control section 120 executes the set of the first image formation operation PA1 (Step S210) and the second image formation operation PA2 (Step S230) again, and performs the determination of Step S232 again. Additionally, at the time of a first image formation operation PA1 after a second image formation operation PA2, the temperature of the second print head 140B, which rose as a result of the second image formation operation PA2, falls to the initial temperature Ti. In this manner, the main control section 120 repeats the set of the first image formation operation PA1 and the second image formation operation PA2 until it is determined that the carriage 130 has reached the end of the main scanning travel direction side of the print medium PM. Additionally, the widths Wp1 along the main scanning direction of the area AR1 in the first image formation operation PA1 and the widths Wp2 along the main scanning direction of the area AR2 in the second image formation operation PA2 may be the same each time or may differ each time. In this manner, even if the first image formation operation PA1 and the second image formation operation PA2 are executed repeatedly, the temperatures of the first print head 140A and the second print head 140B do not reach the upper temperature limit Tth.

Once the set of the first image formation operation PA1 and the second image formation operation PA2 has been executed once or a plurality of times, it is determined that the carriage 130 has reached the end of the main scanning travel direction side of the print medium PM (Step S232: YES). At this time, as shown in FIG. 9B, image formation of one unit band area is completed.

Among each raster (dot row) of each ink color in the images of a unit band formed by the divided print process, rasters in which the number of dots that configure the raster is greater than or equal to the threshold value Tn (=3500) include both dots formed by the first print head 140A and dots formed by the second print head 140B. That is, in such rasters, the number of dots that are included in the first dot group is not zero and the number of dots that are included in the second dot group is not zero, and therefore, a rational number, which is expressed using the number of dots included in the first dot group and the number of dots included in the second dot group in the rasters, is a value other than zero.

When it is determined that the carriage 130 has reached the end of the main scanning travel direction side of the print medium PM, the main control section 120 determines whether or not image formation on all areas of the print medium PM has been completed (Step S240). In a case in which it is determined that image formation on all areas of the print medium PM has not been completed yet (Step S240: NO), the main control section 120 executes a home position return operation of moving the carriage 130 to the end of the main scanning return direction side of the print medium PM without performing ink discharge, and a transport operation of transporting the print medium PM in the sub-scanning direction (sub-scan) (Step S250), and as shown in FIG. 9C, performs the processes from the first image formation operation PA1 (Step S210) onwards with the subsequent unit band area (the second unit band area in the example of FIG. 9C) as the target thereof. The transport amount of the print medium PM in the sub-scanning direction is an amount that is equal to the length of the nozzle row. The above-described processes are repeatedly executed and the divided print process is complete once it is determined that image formation on all areas of the print medium PM has been completed (Step S240: YES).

In the manner described above, the printing apparatus 100 of the embodiment executes the divided print process (FIG. 8) in cases in which the maximum number of dots Nd of each raster (dot row configured by a plurality of dots lined up along the main scanning direction) of images formed by a single main scan (an image formation operation executed between a sub-scan and a subsequent sub-scan) is greater than or equal to the threshold value Tn (3500 in the embodiment). Among each raster (dot row) of each ink color in the images formed by the divided print process, rasters in which the number of dots that configure the raster is greater than or equal to the threshold value include both dots formed by the first print head 140A and dots formed by the second print head 140B. That is, in such rasters, the number of dots that are included in the first dot group is not zero and the number of dots that are included in the second dot group is not zero (a rational number, which is expressed using the number of dots included in the first dot group and the number of dots included in the second dot group in the rasters, is a value other than zero). Therefore, it is possible to realize image formation on the entire print medium PM while avoiding a situation in which the temperature of each print head 140 reaches the upper temperature limit Tth. That is, the printing apparatus 100 of the embodiment can realize image formation on the entire print medium PM while avoiding situations in which the amount of heat per unit time is excessive and deteriorations in image quality, which accompany damage to the components and the destabilization of discharge, irrespective of the contents of target images for printing and the size of the print medium PM. In addition, in the divided print process of the embodiment, since the number of dots that can be formed continuously by each print head 140 is limited, it is possible to prolong component life since the application of excessive loads to the components for the ink discharge operation such as the nozzle actuators 156 is avoided.

In addition, the printing apparatus 100 of the embodiment executes the normal print process in cases in which the maximum number of dots Nd of each raster of images formed by a single main scan is below the threshold value Tn. In the normal print process, all of the plurality of dots that configure each raster are formed by the first print head 140A, and there are no dots that are formed by the second print head 140B. Therefore, in this case, the print process is simplified and it is possible to realize improvements in the speed of the process and the image quality thereof.

In addition, since the printing apparatus 100 of the embodiment alternately executes the image formation operation of the first print head 140A and the image formation operation of the second print head 140B at the time of performing the divided print process, it is possible to adopt a simple configuration in which two print heads 140 are mounted in one carriage 130.

Additionally, the printing apparatus 100 can execute the abovementioned divided print process by determining the number of times of the first image formation operation PA1 and the second image formation operation PA2 that are executed at the time of performing the divided print process and the positions (areas AR1 and AR2) on the print medium PM, dividing the image data ID (or print data) on the basis of the abovementioned number of times and positions and using the divided data.

B. Second Embodiment

Figure 10:
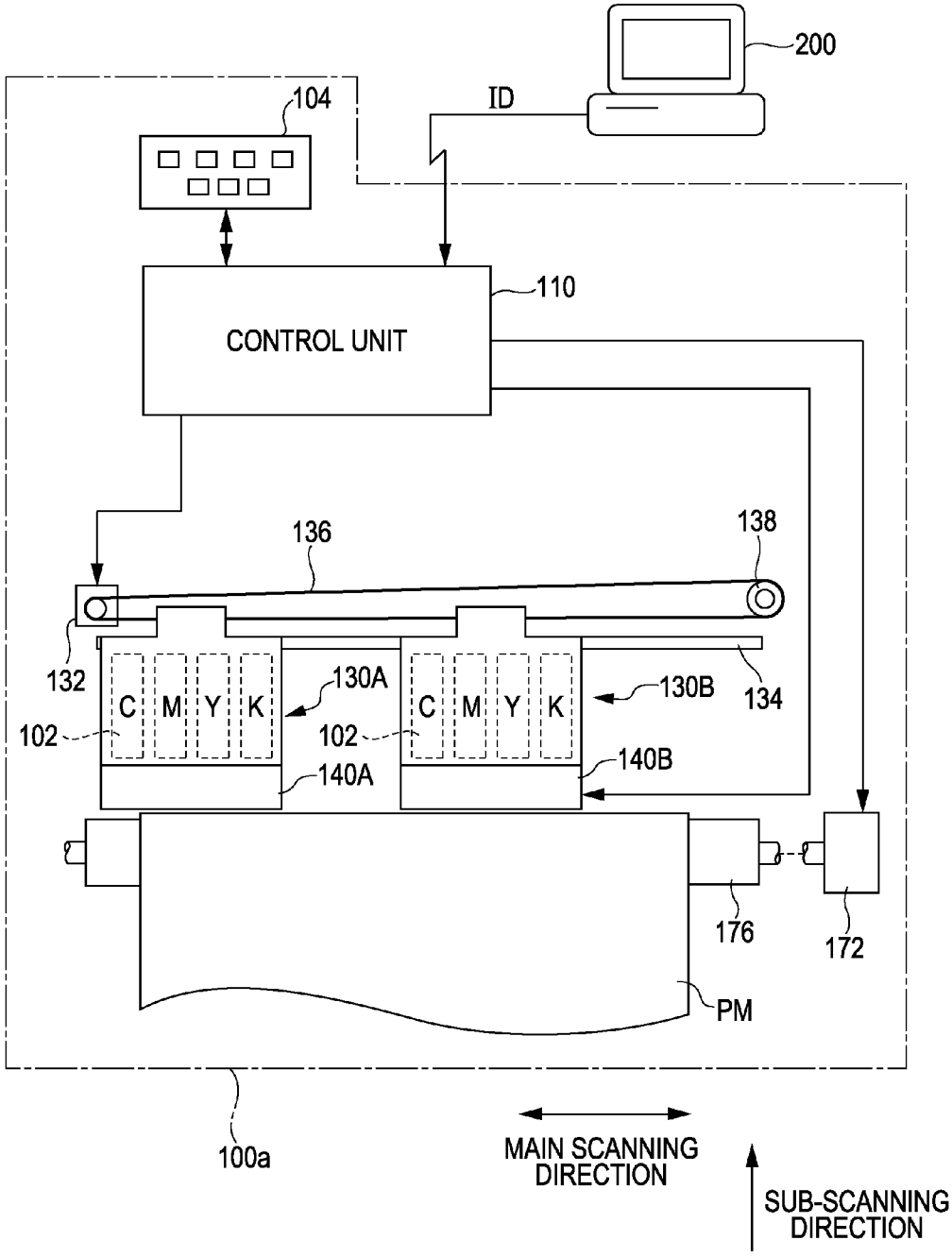
FIG. 10 is an explanatory drawing that shows a schematic configuration of a printing apparatus 100*a* in a second embodiment.

FIG. 10 is an explanatory drawing that shows a schematic configuration of a printing apparatus 100*a* in a second embodiment. The printing apparatus 100*a* in the second embodiment differs from the printing apparatus 100 of the first embodiment that is shown in FIG. 1 in that the printing apparatus 100*a* is provided with two carriages 130 (a first carriage 130A and a second carriage 130B) that correspond to the two print heads 140 (the first print head 140A and the second print head 140B). The remaining configuration of the printing apparatus 100*a* in the second embodiment is the same as that of the first embodiment. In the following description, there are cases in which the first carriage 130A and the second carriage 130B are referred to collectively as the carriages 130.

The two carriages 130 are slidably retained by a common sliding axis 134. When the rotation of the carriage motor 132 is transmitted to the two carriages 130 through the drive belt 136, the two carriages 130 reciprocate along the sliding axis 134 in a state in which the mutual positional relationship thereof is fixed. Since the first print head 140A is mounted in the first carriage 130A and the second print head 140B is mounted in the second carriage 130B, the two print heads 140 also reciprocate along the main scanning direction in a state that accompanies the movement of the two carriages 130 and in which the positional relationship thereof is also fixed. In the present embodiment, at the time of performing a print process on a print medium PM of the maximum width that the printing apparatus 100*a* can accommodate, the area of the print medium PM is split in half along the main scanning direction, an image formation operation on the first split area is executed using the first print head 140A and an image formation operation on the second split area is executed using the second print head 140B at the same time. Therefore, the two carriages 130 (the two print heads 140) reciprocate along the main scanning direction for approximately half of the maximum width of print medium PM that the printing apparatus 100*a* can accommodate in states in which a positional relationship in which there is an interval is retained. That is, the scanning range of the two print heads 140 does not overlap.

A set of ink cartridges 102 is detachably mounted to each carriage 130. The ink that is accommodated in the set of ink cartridges 102 mounted each carriage 130 is supplied to the corresponding print head 140. That is, in the embodiment, a dedicated set of ink cartridges 102 is prepared for each print head 140. Additionally, in the embodiment although the two print heads 140 are separated, the configuration of the disposal of the plurality of nozzles 152 in each print head 140 is the same as that of the first embodiment that is shown in FIG. 2. That is, the positions along the sub-scanning direction of all the nozzle rows 154 that are formed in the two print heads 140 is the same.

In the same manner as the first embodiment that is shown in FIG. 7, in the print process of the printing apparatus 100*a* of the second embodiment, the normal print process is executed in cases in which the maximum number of dots Nd of a raster (a dot row configured by a plurality of dots lined up along the main scanning direction) is below the threshold value Tn (Step S130 in FIG. 7). The normal print process in the second embodiment is a process in which images depending on image data ID are printed on the print medium PM by repeating an operation of forming images on the print medium PM by executing an ink discharge operation depending on image data ID using the first print head 140A while continuously moving the two carriages 130 in the main scanning travel direction (main scan), a home position return operation of moving the two carriages 130 to the home position in the main scanning return direction without performing ink discharge, and a transport operation of the print medium PM in the sub-scanning direction (sub-scan). In the normal print process, an ink discharge operation (image formation operation) using the second print head 140B is not executed. Therefore, all of the plurality of dots that configure each raster (dot row) in images formed using the normal print process are formed by the first print head 140A, and dots formed by the second print head 140B are not included. That is, in each raster, the number of dots that are included in the second dot group is zero.

In the same manner as the first embodiment, the threshold value Tn of the maximum number of dots Nd is set as a value that is smaller than the number of dots that it takes for the temperature of the first print head 140A to reach the upper temperature limit Tth in a case in which dots are formed continuously along the main scanning direction using the first print head 140A. Therefore, in a case in which the maximum number of dots Nd is below the threshold value Tn, even if the image formation operation is performed across the entire print medium width Wm using the first print head 140A, the temperature of the first print head 140A does not reach the upper temperature limit Tth. In addition, since the ink discharge operation is not performed in periods in which the home position return operation and the transport operation are executed, the temperature of the first print head 140A falls. Therefore, even if a normal print process such as that described above is performed, it is possible to complete image formation on the entire print medium PM while avoiding the occurrence of a situation in which the temperature of the first print head 140A exceeds the upper temperature limit Tth.

Figure 11:
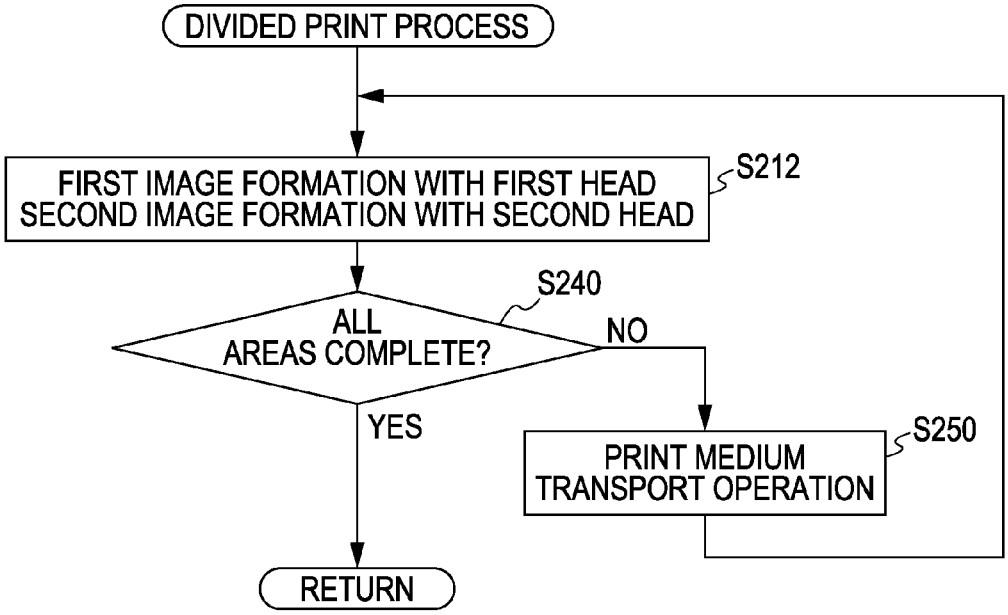
FIG. 11 is a flowchart that shows the flow of a divided print process in the second embodiment.
Figure 12A:
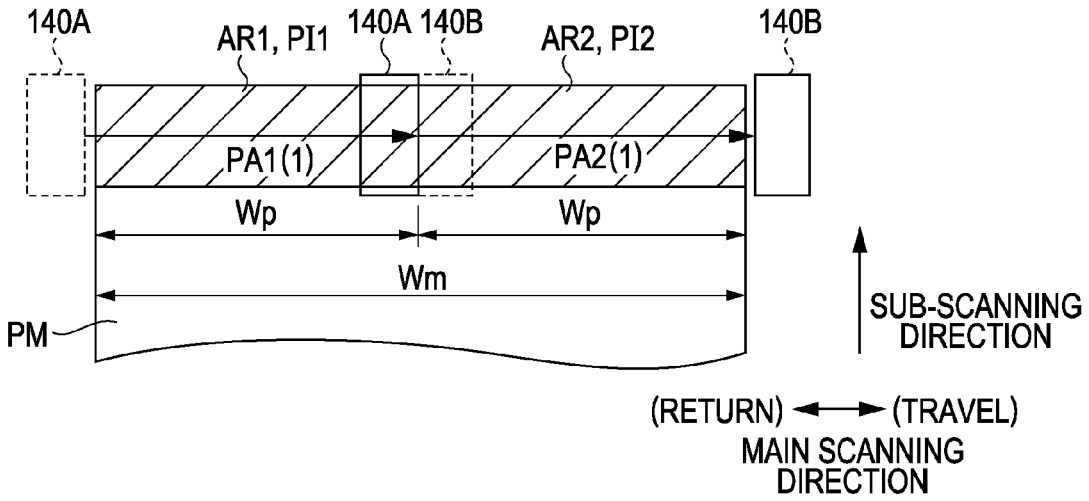
FIGS. 12A and 12B are explanatory drawings that show summaries of the divided print process in the second embodiment.
Figure 12B:
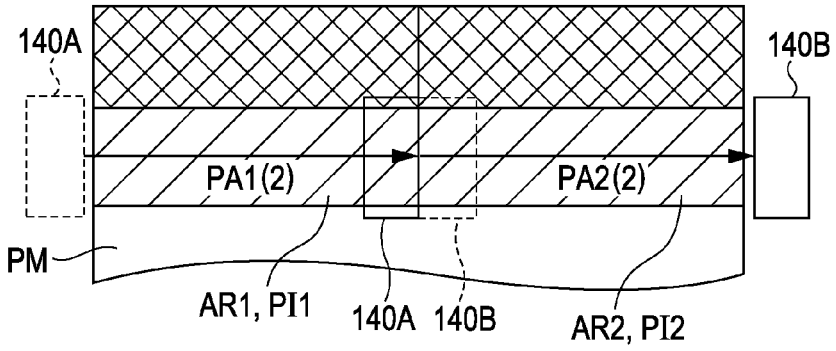

On the other hand, in a case in which the maximum number of dots Nd is greater than or equal to the threshold value Tn, a divided print process is executed (Step S140 in FIG. 7). FIG. 11 is a flowchart that shows the flow of a divided print process in the second embodiment. In addition, FIGS. 12A and 12B are explanatory drawings that show summaries of the divided printing process in the second embodiment. In FIGS. 12A and 12B, a print head 140 that is executing the operations illustrated is shown with a solid line, and a print head 140 that is not contributing to the operations illustrated is shown with a broken line. In addition, images formed by the operations illustrated are shown with single hatching, and images formed before the operations illustrated are shown with cross hatching. The same applies to similar subsequent drawings.

Firstly, the main control section 120 executes a first image formation operation PA1 of forming first images PI1 in an area AR1 of the print medium PM using the first print head 140A (main scan) in addition to executing a second image formation operation PA2 of forming second images PI2 in an area AR2 of the print medium PM using the second print head 140B (main scan) while moving the two carriages 130 over a width Wp in the main scanning travel direction (Step S212). In the embodiment, the width Wp that each carriage 130 moves is half the maximum width of print medium PM that the printing apparatus 100*a* can accommodate. Therefore, in a case in which the width of the print medium PM that is to be used is the maximum width, the widths along the main scanning direction of the area AR1 that the first images PI1 form and the area AR2 that the second images PI2 form are both the width Wp. On the other hand, in cases in which the width of the print medium PM that is to be used is less than the maximum width, the width along the main scanning direction of the area AR1 that the first images PI1 form is the width Wp, but the width along the main scanning direction of the area AR2 that the second images PI2 form is less than the width Wp. Image formation on one unit band area is completed as a result of the first image formation operation PA1 and the second image formation operation PA2.

Among each raster (dot row) of each ink color in the images of a unit band formed by the divided print process, rasters in which the number of dots that configure the raster is greater than or equal to the threshold value Tn (=3500) include both dots formed by the first print head 140A and dots formed by the second print head 140B. That is, in such rasters, the number of dots that are included in the first dot group is not zero and the number of dots that are included in the second dot group is not zero, and therefore, a rational number, which is expressed using the number of dots included in the first dot group and the number of dots included in the second dot group in the rasters, is a value other than zero.

In such a case, each the width Wp that each carriage 130 moves is set so that the number of dots that configure each raster (dot row) of each ink in the first images PI1 and the second images PI2 is less than or equal to the maximum number of dots Nd. Therefore, although the temperatures of the first print head 140A and the second print head 140B rise as a result of the first image formation operation PA1 and the second image formation operation PA2, the temperatures of the first print head 140A and the second print head 140B do not reach the upper temperature limit Tth.

Next, the main control section 120 determines whether or not image formation on all areas of the print medium PM has been completed (Step S240). In a case in which it is determined that image formation on all areas of the print medium PM has not been completed yet (Step S240: NO), the main control section 120 executes a home position return operation of moving the two carriages 130 in the main scanning return direction without performing ink discharge, and a transport operation of transporting the print medium PM in the sub-scanning direction (sub-scan) (Step S250), and as shown in FIG. 12B, performs the first image formation operation PA1 and the second image formation operation PA2 with the subsequent unit band area (the second unit band area in the example of FIG. 12B) as the target thereof (Step S212). The transport amount of the print medium PM in the sub-scanning direction is an amount that is equal to the length of the nozzle row. These processes are repeatedly executed and the divided print process is complete once it is determined that image formation on all areas of the print medium PM has been completed (Step S240: YES).

In the manner described above, the printing apparatus 100*a* of the second embodiment executes the divided print process (FIG. 11) in cases in which the maximum number of dots Nd of each raster (dot row configured by a plurality of dots lined up along the main scanning direction) of images formed by a single main scan (an image formation operation executed between a sub-scan and a subsequent sub-scan) is greater than or equal to the threshold value Tn (3500 in the embodiment). Among each raster (dot row) of each ink color in the images formed by the divided print process, rasters in which the number of dots that configure the raster is greater than or equal to the threshold value Tn include both dots formed by the first print head 140A and dots formed by the second print head 140B. That is, in such rasters, the number of dots that are included in the first dot group is not zero and the number of dots that are included in the second dot group is not zero (a rational number, which is expressed using the number of dots included in the first dot group and the number of dots included in the second dot group in the rasters, is a value other than zero). Therefore, it is possible to realize image formation on the entire print medium PM while avoiding a situation in which the temperature of each print head 140 reaches the upper temperature limit Tth. That is, the printing apparatus 100*a* of the second embodiment can realize image formation on the entire print medium PM while avoiding situations in which the amount of heat per unit time is excessive and deteriorations in image quality, which accompany damage to the components and the destabilization of discharge, irrespective of the contents of target images for printing and the size of the print medium PM. In addition, in the divided print process of the second embodiment, since the number of dots that can be formed continuously by each print head 140 is limited, it is possible to prolong component life since the application of excessive loads to the components for the ink discharge operation such as the nozzle actuators 156 is avoided.

In addition, the printing apparatus 100*a* of the second embodiment executes the normal print process in cases in which the maximum number of dots Nd of each raster of images formed by a single main scan is below the threshold value Tn. In the normal print process, all of the plurality of dots that configure each raster are formed by the first print head 140A, and there are no dots that are formed by the second print head 140B. Therefore, in this case, the print process is simplified and it is possible to realize improvements in the speed of the process and the image quality thereof.

In addition, since the printing apparatus 100*a* of the second embodiment simultaneously executes the image formation operation of the first print head 140A and the image formation operation of the second print head 140B at the time of performing the divided print process, it is possible to achieve an increase in the speed of the print process.

Additionally, the printing apparatus 100*a* can execute the abovementioned divided print process by determining the number of times of the first image formation operation PA1 and the second image formation operation PA2 that are executed at the time of performing the divided print process and the positions (areas AR1 and AR2) on the print medium PM, dividing the image data ID (or print data) on the basis of the abovementioned number of times and positions and using the divided data.

C. Modification Examples

Additionally, the invention is not limited to the abovementioned embodiments and examples, and can be implemented in various forms within a range that does not depart from the scope thereof. For example, the invention can be implemented as the following modification examples.

C1. Modification Example 1

The configuration of the printing apparatus 100 in the abovementioned embodiments is merely an example and various modifications are possible. For example, in the abovementioned embodiments, the printing apparatus 100 performs the print process by receiving image data ID from a host computer 200, but instead of this, the printing apparatus 100 may, for example, perform the print process on the basis of image data acquired from a memory card, image data acquired from a digital camera through a predetermined interface or image data acquired using a scanner.

In addition, in the abovementioned embodiments, the main control section 120 of the printing apparatus 100 that had received image data ID performs calculation processes for printing execution such as an image development process, a color conversion process, an ink color classification process and a halftone process, but these calculation processes may be executed by the host computer 200. In such a case, the printing apparatus 100 receives a print command that has been generated by the calculation processes of the host computer 200, and performs a print process according to the print command. In this case also, the printing apparatus 100 can execute the same print process as that described in the abovementioned embodiments.

In addition, in the abovementioned embodiments, the print head 140 has the discharge limiting section 169, but the print head 140 may be provided without the discharge limiting section 169, and the control unit 110 may have a functional section that is the same as the discharge limiting section 169. In such as case, the detection result of the temperature of the print head 140 using the thermistor 144 is sent to the control unit 110, and the control unit 110 limits the ink discharge operation in the same manner as that in the abovementioned embodiments on the basis of the received temperature detection result.

In addition, in the abovementioned embodiments, since the occurrence of a situation in which the temperature of the print head 140 exceeds the upper temperature limit Tth is avoided as a result of the control of the main control section 120, it is possible to achieve simplification and a reduction in cost of the configuration of the apparatus by omitting the thermistor 144 and the discharge limiting section 169. Alternatively, it is possible to use the control of the main control section 120 as a backup in a case in which there is a defect with the operation of the thermistor 144 and the discharge limiting section 169.

In addition, in the abovementioned embodiments, the printing apparatus 100 performs the print process using the four ink colors of cyan, magenta, yellow and black, but the number and type of ink colors that the printing apparatus 100 uses in the print process is not limited thereto. For example, the printing apparatus 100 may perform the print process using a total of six colors of ink by adding light cyan and light magenta to the four colors of cyan, magenta, yellow and black.

In addition, in the abovementioned embodiments, the printing apparatus 100 is a so-called on carriage type printer in which the ink cartridges 102 reciprocate in the main scanning direction along with the carriage 130, but the invention may also be applied to a so-called off-carriage type printer in which a holder that attaches the ink cartridges 102 is provided in a different location to that of the carriage 130, and ink is supplied from the ink cartridges 102 to the print head 140 through a flexible tube or the like. In addition, in the abovementioned first embodiment, one common set of ink cartridges 102 respectively supplies ink to both the first print head 140A and the second print head 140B, but a designated set of ink cartridges 102 may be respectively prepared for first print head 140A and the second print head 140B, and ink may be supplied from the designated ink cartridges 102 to the corresponding print head 140. In addition, in the abovementioned second embodiment, a designated set of ink cartridges 102 is respectively prepared for first print head 140A and the second print head 140B, but one set of ink cartridges 102 may respectively provide ink to the both the first print head 140A and the second print head 140B. In addition, the invention may be applied to printing apparatuses that form images on a print medium PM using fluid other than ink (including liquid bodies in which particles of functional materials are dispersed and fluid bodies such as gel).

In addition, in the abovementioned embodiments, the first print head 140A and the second print head 140B are the same (same model number), but the first print head 140A and the second print head 140B may be print heads that differ (in model number). In addition, in the abovementioned embodiments, the printing apparatus 100 is provided with two print heads 140, but the printing apparatus 100 may be provided with three or more print heads 140. In a case in which the printing apparatus 100 is provided with three or more print heads 140, it is possible to realize the divided print process that executes image formation operations using the 3 or more print heads 140 in order in the same manner as the first embodiment. Alternatively, in a case in which the printing apparatus 100 is provided with three or more print heads 140, it is possible to realize the divided print process that executes image formation operations using the 3 or more print heads 140 at the same time in the same manner as the second embodiment.

Figure 13:
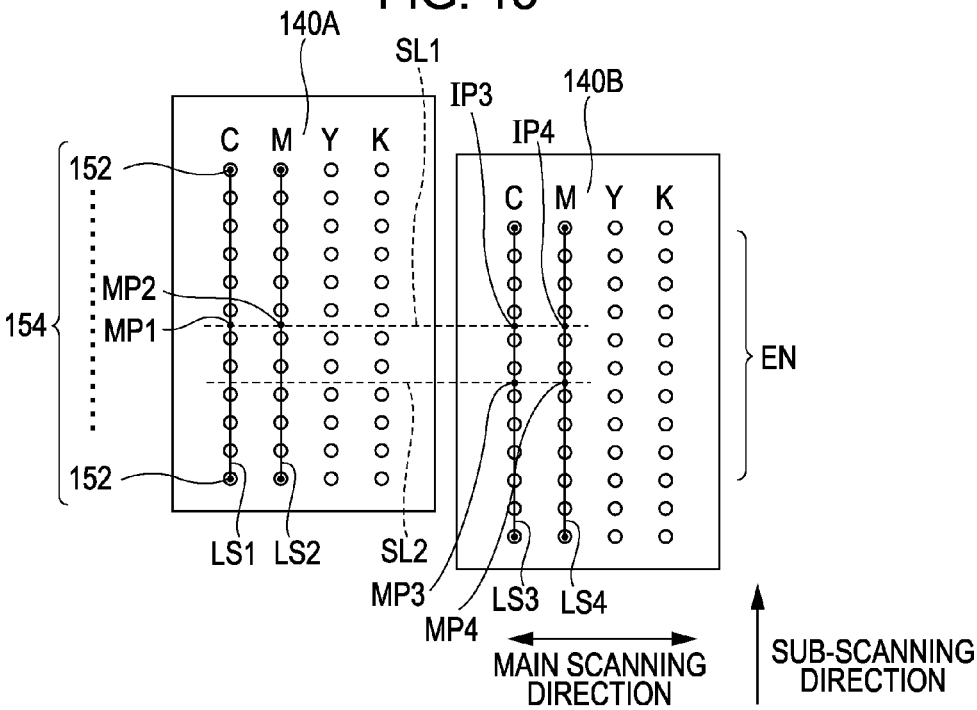
FIG. 13 is an explanatory drawing that shows a configuration of a nozzle formation surface of each print head 140 in a modification example.

In addition, in the abovementioned embodiments, the positions along the sub-scanning direction of all the nozzle rows 154 that are formed in the two print heads 140 is the same, but the invention is not limited to this configuration. FIG. 13 is an explanatory drawing that shows a configuration of a nozzle formation surface of each print head 140 in a modification example. In the modification example shown in FIG. 13, since the positions along the sub-scanning direction of the two print heads 140 are shifted, the positions along the sub-scanning direction of the nozzle rows 154 that are formed in the first print head 140A and the positions along the sub-scanning direction of the nozzle rows 154 that are formed in the second print head 140B are shifted. In this regard, in the modification example shown in FIG. 13, a portion of 75% or more of the nozzle rows 154 that are formed in the first print head 140A and the nozzle rows 154 that are formed in the second print head 140B respectively overlap in the main scanning direction. That is, in the modification example shown in FIG. 13, a first straight line SL1, which links a central point MP1 of a first line segment LS1 that links the nozzles 152 of both ends of the first nozzle row (the cyan ink nozzle row 154 of the first print head 140A) and a central point MP2 of a second line segment LS2 that links the nozzles 152 of both ends of the second nozzle row (the magenta ink nozzle row 154 of the first print head 140A), crosses a third line segment LS3 that links the nozzles 152 of both ends of the third nozzle row (the cyan ink nozzle row 154 of the second print head 140B) and a fourth line segment LS4 that links the nozzles 152 of both ends of the fourth nozzle row (the magenta ink nozzle row 154 of the second print head 140B). In addition, the second straight line SL2, which links a central point MP3 of the third line segment LS3 and a central point MP4 of the fourth line segment LS4, crosses the first line segment LS1 and the second line segment LS2. Furthermore, the distance between an intersection IP3 of the first straight line SL1 and the third line segment LS3 and the central point MP3 of the third line segment LS3 is shorter than the distance between the intersection IP3 and an end point on the near side of the third line segment LS3. In the modification example shown in FIG. 13, at the time of the divided print process (Step S140 in FIG. 7), among each of the nozzle rows 154 respectively provided in the first print head 140A and the second print head 140B, only nozzles 152 of portions that overlap the nozzle rows 154 of the other print head 140 in the main scanning direction are used, and the remaining nozzles 152 are not used. In the modification example shown in FIG. 13, since the divided print process can be executed using 75% or more of the nozzles 152 that configure each nozzle row 154 provided in each print head 140, it is possible to effectively suppress increases in the time required for the divided print process.

Figure 14:
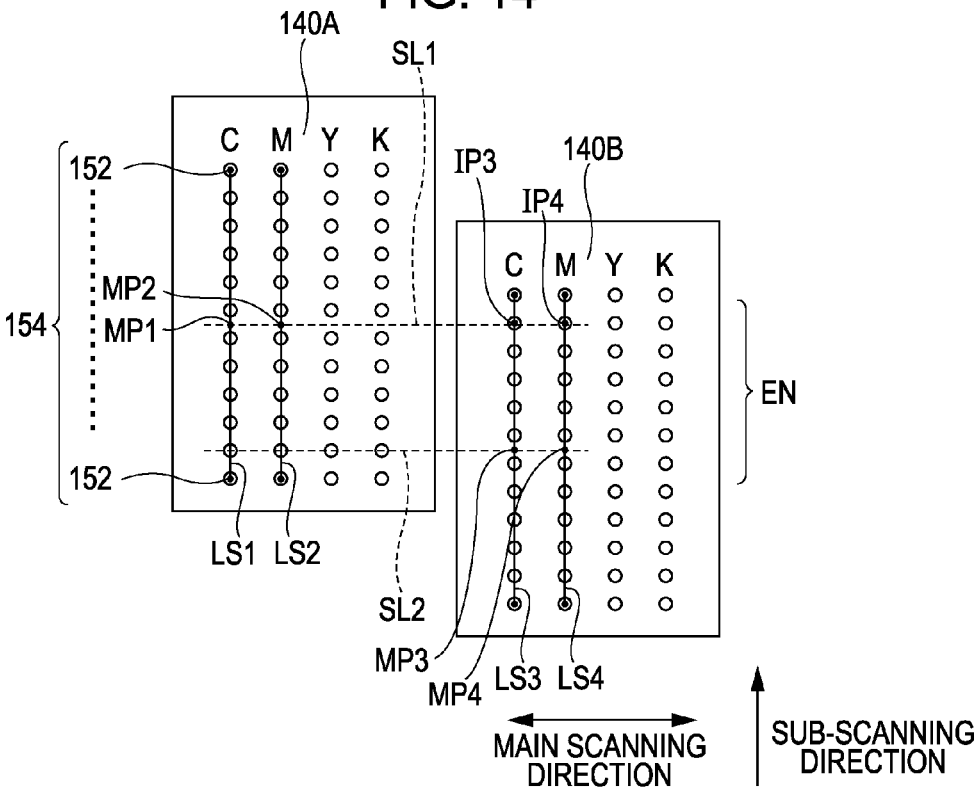
FIG. 14 is an explanatory drawing that shows a configuration of a nozzle formation surface of each print head 140 in a different modification example.

FIG. 14 is an explanatory drawing that shows a configuration of a nozzle formation surface of each print head 140 in a different modification example. In the modification example shown in FIG. 14, since the positions along the sub-scanning direction of the two print heads 140 are shifted to a greater extent than the modification example shown in FIG. 13, the positions along the sub-scanning direction of the nozzle rows 154 that are formed in the first print head 140A and the positions along the sub-scanning direction of the nozzle rows 154 that are formed in the second print head 140B are shifted to a greater extent than that of the modification example shown in FIG. 13. In this regard, in the modification example shown in FIG. 14, 50% or more of the nozzle rows 154 that are formed in the first print head 140A and the nozzle rows 154 that are formed in the second print head 140B respectively overlap in the main scanning direction. That is, in the modification example shown in FIG. 14, a first straight line SL1, which links a central point MP1 of a first line segment LS1 that links the nozzles 152 of both ends of the first nozzle row (the cyan ink nozzle row 154 of the first print head 140A) and a central point MP2 of a second line segment LS2 that links the nozzles 152 of both ends of the second nozzle row (the magenta ink nozzle row 154 of the first print head 140A), crosses a third line segment LS3 that links the nozzles 152 of both ends of the third nozzle row (the cyan ink nozzle row 154 of the second print head 140B) and a fourth line segment LS4 that links the nozzles 152 of both ends of the fourth nozzle row (the magenta ink nozzle row 154 of the second print head 140B). In addition, the second straight line SL2, which links a central point MP3 of the third line segment LS3 and a central point MP4 of the fourth line segment LS4, crosses the first line segment LS1 and the second line segment LS2. In this regard, the distance between an intersection IP3 of the first straight line SL1 and the third line segment LS3 and the central point MP3 of the third line segment LS3 is longer than the distance between the intersection IP3 and an end point on the near side of the third line segment LS3. In the modification example shown in FIG. 14, at the time of the divided print process (Step S140 in FIG. 7), among each of the nozzle rows 154 respectively provided in the first print head 140A and the second print head 140B, only nozzles 152 of portions that overlap the nozzle rows 154 of the other print head 140 in the main scanning direction are used, and the remaining nozzles 152 are not used. In the modification example shown in FIG. 14, since the divided print process can be executed using 50% or more of the nozzles 152 that configure each nozzle row 154 provided in each print head 140, it is possible to effectively suppress increases in the time required for the divided print process.

In addition, in the abovementioned embodiments, the portion of the configuration that is realized using hardware may be substituted with software and conversely, the portion of the configuration that is realized using software may be substituted with hardware.

In addition, in a case in which either a portion of or all of the functions of the invention are realized using software, the software (computer program) can be provided in a format of being stored on a recordable medium that is readable by a computer. In this invention, "a recordable medium that is readable by a computer" is not limited to portable recordable media such as flexible discs and CD-ROMs, and also includes computer internal storage units such as various types of RAM and ROM and external storage units that are fixed to a computer such as hard disks.

C2. Modification Example 2

In the abovementioned first embodiment, the normal print process is executed in a case in which the maximum number of dots Nd is below the threshold value Tn, but the divided print process may be performed even in cases in which the maximum number of dots Nd is below the threshold value Tn. According to this configuration, it is possible to suppress bias in the frequency of use of each print head 140, and it is possible to realize prolongation of the life of the printing apparatus 100 as a whole by avoiding common occurrence of specific print head 140 breakdowns.

C3. Modification Example 3

In the abovementioned embodiments, the printing apparatus 100 acquires the print resolution Rp and a width Wm along the main scanning direction of the print medium PM, and calculates the maximum number of dots Nd by multiplying the print resolution Rp by the print medium width Wm, but in a case in which the print resolution Rp of the printing apparatus 100 is fixed, the printing apparatus 100 may calculate the maximum number of dots Nd on the basis of the width Wm along the main scanning direction of the print medium PM without acquiring the print resolution Rp for each print process. In addition, the printing apparatus 100 may save a table that shows a correspondence between a combination of the print resolution Rp and width Wm of the print medium PM (or the width Wm of the print medium PM only) and a result of the determination of whether or not the maximum number of dots Nd is greater than or equal to the threshold value Tn (Step S120 in FIG. 7), and may perform the abovementioned determination by referring to the table when a combination of the print resolution Rp and width Wm of the print medium PM (or the width Wm of the print medium PM only) is specified in the table.

In addition, in the abovementioned embodiments, the determination of whether to execute normal printing or divided printing (the determination of whether or not the number of dots that configure each raster of each ink color is greater than to equal to the threshold value Tn or not) is performed using the maximum number of dots Nd, but the abovementioned determination may be performed using image data ID in addition to the maximum number of dots Nd. For example, the abovementioned determination may be performed by calculating the number of dots that configure each raster that is formed in practical terms on the basis of the maximum number of dots Nd and the image data ID, and a comparing the calculated number of dots and the threshold value Tn.

C4. Modification Example 4

In the abovementioned embodiments, at the time of normal printing, only the ink discharge operation (image formation operation) of the first print head 140A is executed and the ink discharge operation of the second print head 140B is not executed, but conversely, normal printing may be performed by only executing the ink discharge operation (image formation operation) of the second print head 140B and not executing the ink discharge operation of the first print head 140A.

C5. Modification Example 5

In the divided print process in the abovementioned embodiments, image formation in an area that is scanned is completed by a single first image formation operation PA1 and single second image formation operation PA2, but the divided print process is not necessarily limited to this configuration. For example, only a portion of the rasters (lines configured by a plurality of dots lined up along the main scanning direction) that form images that are to be formed in an area that is scanned may be formed by a single first image formation operation PA1 and single second image formation operation PA2, and different rasters that form images that are to be formed in the area may be formed by a different single first image formation operation PA1 and single second image formation operation PA2. That is, the print process may be performed using a so-called interlaced method.

C6. Modification Example 6

In the divided print process in the abovementioned embodiments, the movement direction of the carriage 130 in the first image formation operation PA1 and the second image formation operation PA2 is the main scanning travel direction at all times (that is, so called one-way printing is performed), but so-called two-way printing, in which an operation of performing image formation while moving the carriage 130 in the main scanning travel direction and an operation of performing image formation while moving the carriage 130 in the main scanning return direction are repeatedly executed, may be performed.

The entire disclosure of Japanese Patent Application No. 2012-154353, filed Jul. 10, 2012 is expressly incorporated by reference herein.

What is claimed is:

1. A printing apparatus comprising:

a first head that has a first nozzle row that is configured from a plurality of nozzles that discharge a first chromatic ink and a second nozzle row that is configured from a plurality of nozzles that discharge a second chromatic ink, the first head forming a first dot group on a print medium by moving along a guide member in a main scanning direction and discharging ink using at least the first nozzle row or the second nozzle row;

a second head, different from the first head, that has a third nozzle row that is configured from a plurality of nozzles that discharge the first chromatic ink and a fourth nozzle row that is configured from a plurality of nozzles that discharge the second chromatic ink, the second head forming a second dot group on the print medium by moving along the guide member in the main scanning direction and discharging ink using at least the third nozzle row or the fourth nozzle row;

a transport mechanism that performs a sub-scan that moves the print medium relatively with respect to the guide member in a sub-scanning direction that intersects the main scanning direction;

a controller that controls the first and second print heads, wherein, when a number of dots to be formed in one raster by either the plurality of nozzles in the first nozzle row or by the plurality of nozzles in the second nozzle row, as a result of ink to be discharged between a sub-scan and a subsequent sub-scan, is greater than or equal to a predetermined number, then the controller causes both the first print head and the second print head to execute ,printing of the raster, the first dot group and the second dot group being formed on different areas of the print medium, and wherein, when a number of dots to be formed in one raster by either the plurality of nozzles in the first nozzle row or by the plurality of nozzles in the second nozzle row as a result of ink to be discharged between a sub-scan and a subsequent sub-scan, is less than the predetermined number, then the controller causes one of the first print head and the second print head to execute printing of the raster.

2. The printing apparatus according to claim 1, wherein in a case in which the number of dots to be formed in one raster by either the plurality of nozzles in the first nozzle row or by the plurality of nozzles in the second nozzle row is greater than or equal to the predetermined number, the ink discharge of the first head and the ink discharge of the second head are executed alternately.

3. The printing apparatus according to claim 1, wherein in a case in which the number of dots to be formed in one raster by either the plurality of nozzles in the first nozzle row or by the pluralitv of nozzles the second nozzle row is greater than or equal to the predetermined number, the ink discharge of the first head and the ink discharge of the second head are executed simultaneously.

4. The printing apparatus according to claim 1, wherein the ordered relationship of the first and second nozzle rows with respect to one another on the first print head is same as the ordered relationship of the third and fourth nozzle rows on the second print head with respect to one another.

* * * * *